US008090287B2

(12) United States Patent
Hoshio

(10) Patent No.: US 8,090,287 B2
(45) Date of Patent: Jan. 3, 2012

(54) CHARGING MEMBER CLEANING UNIT, METHOD OF PRODUCING CHARGING MEMBER CLEANING UNIT, CHARGING DEVICE, PROCESS CARTRIDGE AND IMAGE FORMING APPARATUS

(75) Inventor: Takuro Hoshio, Minamiashigara (JP)

(73) Assignee: Fuji Xerox Co., Ltd., Tokyo (JP)

( * ) Notice: Subject to any disclaimer, the term of this patent is extended or adjusted under 35 U.S.C. 154(b) by 757 days.

(21) Appl. No.: 12/170,813

(22) Filed: Jul. 10, 2008

(65) Prior Publication Data

US 2009/0162092 A1 Jun. 25, 2009

(30) Foreign Application Priority Data

Dec. 25, 2007 (JP) ..... 2007-332811

(51) Int. Cl.
*G03G 15/02* (2006.01)

(52) U.S. Cl. ..... 399/100; 399/176

(58) Field of Classification Search ..... 399/100, 399/176, 357

See application file for complete search history.

(56) References Cited

U.S. PATENT DOCUMENTS

| | | | | |
|---|---|---|---|---|
| 5,283,145 | A | 2/1994 | Nukada et al. | |
| 5,290,928 | A | 3/1994 | Nukada et al. | |
| 5,298,617 | A | 3/1994 | Nukada et al. | |
| 5,302,479 | A | 4/1994 | Daimon et al. | |
| 5,308,728 | A | 5/1994 | Imai et al. | |
| 5,338,636 | A | 8/1994 | Nukada et al. | |
| 5,358,813 | A | 10/1994 | Iijima et al. | |
| 5,378,569 | A | 1/1995 | Nukada et al. | |
| 5,393,629 | A | 2/1995 | Nukada et al. | |
| 5,416,207 | A | 5/1995 | Imai et al. | |
| 5,459,004 | A | 10/1995 | Katsumi et al. | |
| 5,463,043 | A | 10/1995 | Nukada et al. | |
| 5,639,581 | A | 6/1997 | Iwasaki et al. | |
| 5,654,119 | A | 8/1997 | Ishii et al. | |
| 5,734,003 | A | 3/1998 | Iwasaki et al. | |
| 6,701,105 | B2 | 3/2004 | Funabashi | |
| 7,062,194 | B2 | 6/2006 | Yanagida et al. | |
| 7,218,877 | B2 | 5/2007 | Yanagida et al. | |
| 2003/0039483 | A1 | 2/2003 | Funabashi | |
| 2004/0228648 | A1 | 11/2004 | Yanagida et al. | |
| 2005/0191081 | A1 * | 9/2005 | Muraishi et al. | 399/100 |
| 2006/0165431 | A1 | 7/2006 | Yanagida et al. | |
| 2007/0177891 | A1 | 8/2007 | Honobe et al. | |

(Continued)

FOREIGN PATENT DOCUMENTS

CN 1550933 A 12/2004

(Continued)

OTHER PUBLICATIONS

Feb. 9, 2010 Office Action issued in Japanese Patent Application No. 2007-332811 (with translation).

(Continued)

*Primary Examiner* — Hoang Ngo
(74) *Attorney, Agent, or Firm* — Oliff & Berridge, PLC

(57) ABSTRACT

A charging member cleaning unit, that contacts a charging member that charges the surface of an image holding member provided in an image forming apparatus, and is used for cleaning the surface of that charging member, has an elastic layer, and has an amine content within the elastic layer of not more than approximately 60 ppm.

14 Claims, 11 Drawing Sheets

U.S. PATENT DOCUMENTS

| | | | | |
|---|---|---|---|---|
| 2007/0230997 | A1 | 10/2007 | Matsui | |
| 2007/0292158 | A1 * | 12/2007 | Matsumoto et al. | 399/100 |

FOREIGN PATENT DOCUMENTS

| | | |
|---|---|---|
| JP | A-47-030330 | 11/1972 |
| JP | A-04-189873 | 7/1992 |
| JP | A-05-043813 | 2/1993 |
| JP | A-05-098181 | 4/1993 |
| JP | A-05-140472 | 6/1993 |
| JP | A-05-140473 | 6/1993 |
| JP | A-05-263007 | 10/1993 |
| JP | A-05-279591 | 10/1993 |
| JP | A-08-176293 | 7/1996 |
| JP | A-08-208820 | 8/1996 |
| JP | B2-2847524 | 11/1998 |
| JP | A-2000-347514 | 12/2000 |
| JP | A-2001-290340 | 10/2001 |
| JP | A-2003-066807 | 3/2003 |
| JP | A-2004-361916 | 12/2004 |
| JP | A-2006-189894 | 7/2006 |
| JP | A-2007-206340 | 8/2007 |
| JP | A-2007-271759 | 10/2007 |
| JP | A-2007-310078 | 11/2007 |
| JP | A-2007-316256 | 12/2007 |

OTHER PUBLICATIONS

Notice of Grounds for Rejection for corresponding Japanese Application No. 2007-332811, mailed on Jun. 1, 2010 (w/ English translation).

Office Action dated Jun. 24, 2011 issued in Chinese Patent Application No. 200810210986.X (with translation).

* cited by examiner

CHARGING MEMBER CLEANING UNIT, METHOD OF PRODUCING CHARGING MEMBER CLEANING UNIT, CHARGING DEVICE, PROCESS CARTRIDGE AND IMAGE FORMING APPARATUS

CROSS-REFERENCE TO RELATED APPLICATIONS

This application is based on and claims priority under 35 USC 119 from Japanese Patent Application No. 2007-332811, filed Dec. 25, 2007.

BACKGROUND

1. Technical Field

The present invention relates to a charging member cleaning unit, a method of producing a charging member cleaning unit, a charging device, a process cartridge, and an image forming apparatus.

2. Related Art

In image forming apparatuses such as electrophotographic copying machines, laser beam printers, and electrostatic recording devices, where an electrophotographic method is used to generate a toner image on the surface of an image holding member, and then transfer that toner image to a transfer target such as a sheet of paper, a photoreceptor drum is used as the image holding member. A corotron member is positioned near the photoreceptor drum, and the electrical discharge from the corotron member is used to substantially uniformly charge the surface of the photoreceptor drum. However, when a corotron member is used, a high voltage of several kV is applied in order to charge the surface of the photoreceptor drum to a predetermined potential, and this corona discharge generates ozone, which can cause degradation of the rubber and/or the photoreceptor provided inside the image forming apparatus. Accordingly, in image forming apparatuses that use the type of corotron member described above, not only the materials and shapes of the members used inside the apparatus are selected with care, but the apparatus also are provided with an exhaust fan to expel the ozone from the apparatus and/or an auxiliary device that detoxifies the ozone contained within the exhaust gas.

Furthermore, in an apparatus provided with a corona discharge device such as a corotron member, dust or fixing oil or the like floating within the air inside the apparatus may contaminate the corotron wire, making substantially uniform charging of the photoreceptor drum impossible, and increasing the likelihood of image irregularities. In order to allow periodic cleaning of the corotron wire to prevent electrical discharge irregularities, a cleaning device or the like may be positioned on the corotron wire, so that the wire can be cleaned periodically. However, providing a cleaning device for the corotron wire amounts to the provision of an additional device, which is not only a problem in terms of space, but the inclusion of an additional device for a small photoreceptor drum or the like also increases the restrictions associated with designing the apparatus. In order to address these problems associated with the use of a corotron wire, the use of a charging member such as a charging roller, which is brought into contact with the photoreceptor drum to effect charging, is attracting considerable attention.

In devices that use a charging device such as this type of charging roller, substantially uniform charging of the photoreceptor surface is a requirement, but during operation, dirt (mainly the toner external additives) gradually adheres to and accumulates on the surface of the charging member, and this adhered dirt can cause variations in the electrical resistance and the surface state of the charging member, thereby inhibiting substantially uniform charging. In order to prevent this soiling caused by external additives and the like, and enable a favorable image to be maintained over a long period of time, various charging member cleaning units are being tested for cleaning the charging roller.

SUMMARY

According to an aspect of the present invention, there is provided a charging member cleaning unit, that contacts a charging member that charges the surface of an image holding member provided in an image forming apparatus, has an elastic layer, and has an amine content within the elastic layer of not more than approximately 60 ppm.

BRIEF DESCRIPTION OF THE DRAWINGS

Exemplary embodiments of the present invention will be described in detail based on the following figures, wherein.

DETAILED DESCRIPTION

Figure 1:
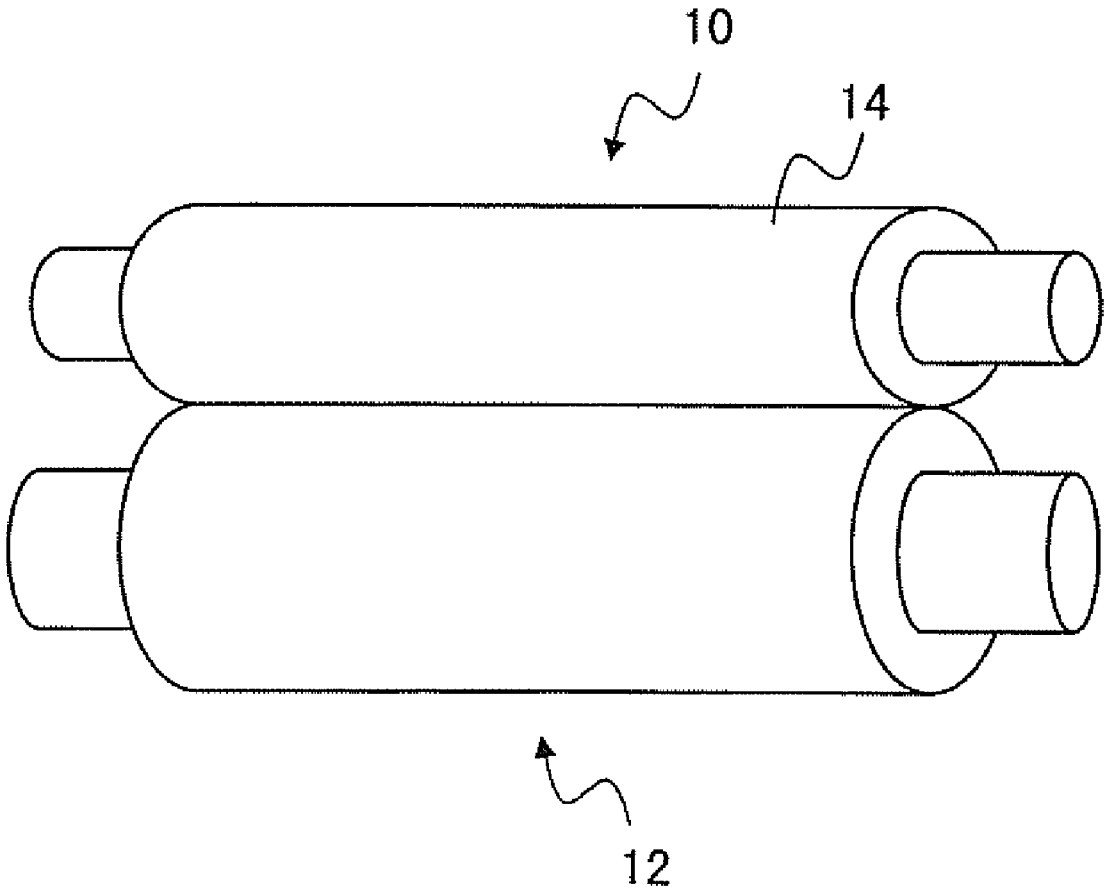
FIG. 1 is a schematic illustration showing an example of a charging device according to an exemplary embodiment of the present invention.

Exemplary embodiments of the present invention are described below. These exemplary embodiments of the present invention are merely examples of implementing the present invention, and the present invention is in no way limited by these embodiments.

In those cases where an amine compound such as triethylenediamine is used as the general catalyst during the production of a polyurethane foam material for use in the elastic layer of a charging member cleaning unit, if, within the resulting process cartridge or image forming apparatus or the like that is equipped with the charging member cleaning unit having the elastic layer composed of the polyurethane foam material, the charging member remains in the same location for a long period, either contacting or in the vicinity of the elastic layer, then the triethylenediamine or the like tends to adhere to the surface of the charging member, causing unsatisfactory charging within that region of the member. This results in an unsatisfactory image, and means that achieving both favorable cleaning performance over a long period of time and favorable image retention following storage within the process cartridge may be impossible.

<Charging Member Cleaning Unit>

A charging member cleaning unit according to an exemplary embodiment of the present invention contains an elastic layer, and the amine content within that elastic layer is not more than approximately 60 ppm. If the amine content within the elastic layer exceeds approximately 60 ppm, then the cleaning performance cannot be maintained over a long period of time. The amine content within the elastic layer is preferably not more than approximately 30 ppm.

Examples of the amines that affect the cleaning performance and the image quality include primary amines, secondary amines and tertiary amines, and the quantity of these amines is not more than approximately 60 ppm. In particular, the tertiary amine content is preferably not more than approximately 60 ppm, as these tertiary amines may react with the ions such as chlorine ions generated from the charging member, generating quaternary ammonium salts which have an adverse effect on the image quality.

The amine content within the elastic layer can be measured using a gas chromatograph apparatus. The lower detection limit for this measurement is typically approximately 0.1 ppm.

Furthermore, the hardness of the elastic layer is preferably within a range from not less than approximately 100 N to not more than approximately 500 N. If the hardness of the elastic layer is less than approximately 100 N, then the cleaning performance may be inadequate, whereas if the hardness exceeds approximately 500 N, then the elastic layer may damage the surface of the charging member.

The charging member cleaning unit according to an exemplary embodiment of the present invention may be either a cleaning roller that includes a core and a circular cylindrical elastic layer formed around the outer periphery of the core, or a cleaning blade that is equipped with an elastic layer.

Free cutting steel or stainless steel or the like can be used as the material for the cleaning roller core, and the material and surface treatment used on that material may be selected appropriately in accordance with the intended application and properties such as the sliding properties. Materials that lack conductivity may be imparted with conductivity by processing using a typical treatment such as plating or the like, or may be simply used as is. Furthermore, because the cleaning roller contacts the charging roller via the elastic layer with a suitable nip pressure, the material for the cleaning roller core preferably has sufficient strength to ensure almost no bending during nipping, and the shaft diameter is preferably selected so as to exhibit adequate stiffness relative to the shaft length.

The elastic layer can be formed using a foam material having a porous three dimensional structure. The foam material can be selected from foamable resins such as polyurethanes, polyethylenes, polyamides and polypropylenes, or materials obtained from nitrile rubbers (NBR), ethylene-propylene-diene ternary copolymer rubbers (EPDM), styrene-butadiene rubbers (SBR) or silicone rubbers. In order to ensure that the elastic layer not only effectively cleans away foreign matter by a driven rubbing motion against the charging roller, but also causes almost no scratches as it rubs against the surface of the charging roller, and causes almost no fine scratching or damage to the charging roller even over an extended period of time, the elastic layer is preferably at least one of a polyurethane, a nitrile rubber, an ethylene-propylene-diene ternary copolymer rubber or a silicone rubber, which exhibit high levels of tear strength and tensile strength. From the viewpoints of ensuring a favorable cleaning performance and retaining that cleaning performance, the use of a polyurethane is particularly desirable.

A polyurethane foam may be a foam obtained by reacting a polyol and an isocyanate, and any conventional method may be used, provided it yields the desired foam properties.

Examples of polyols that can be used include polyoxypropylene glycols, polyoxytetramethylene glycols, polyester polyols, polycaprolactone polyols and polycarbonate polyols. These polyols may be used either alone, or in mixtures containing two or more different compounds.

Polyester polyols are obtained, for example, by a dehydration-condensation of a dibasic acid and a hydroxyl compound. Examples of the main adipate-based polyols include ethylene glycol adipate, diethylene glycol adipate, butylene glycol adipate, and trimethylolpropane/diethylene glycol adipate.

Examples of the condensed polyester polyols include compounds obtained by a condensation of a dicarboxylic acid such as adipic acid, glutaric acid, succinic acid, sebacic acid, pimeric acid or suberic acid, and either a diol such as ethylene glycol, diethylene glycol, 1,4-butanediol, 1,6-hexanediol, propylene glycol or neopentyl glycol, or a triol such as trimethylolethane or trimethylolpropane. Furthermore, polycarbonate-based polyols such as polycarbonate diols having structures in which alkylene groups (such as hexylene groups) or xylylene groups or the like are bonded to the principal chain via carbonate linkages may also be used as condensed polyester polyols.

Examples of isocyanate compounds that can be used include tolylene diisocyanate, diphenylmethane diisocyanate, naphthalene diisocyanate, tolidine diisocyanate, isophorone diisocyanate, hexamethylene diisocyanate, xylylene diisocyanate, hydrogenated xylylene diisocyanate, hydrogenated diphenylmethane diisocyanate, triisocyanates, tetramethylxylene diisocyanate, lysine ester triisocyanate, lysine diisocyanate, trimethylhexamethylene diisocyanate, dimer acid diisocyanate and norbornene diisocyanate. These isocyanates may be used either alone, or in mixtures containing two or more different compounds.

There are no particular restrictions on the blend ratio between the polyol and the isocyanate, provided the desired properties are obtained, although the molar ratio between isocyanate groups within the isocyanate compound and hydroxyl groups within the polyol is preferably not less than approximately 0.8 and not more than approximately 2.0, and ratios of not less than approximately 0.9 and not more than approximately 1.3 are particularly desirable.

Additives such as curing agents, crosslinking agents, catalysts, foaming agents, flame retardants, age resistors, plasticizers, foam regulators and conductive agents may also be added as polyurethane foam raw materials. In those cases where an amine compound is used as one of these additives within the polyurethane foam, the quantity of that amine additive within the polyurethane foam is preferably kept to a minimum.

Examples of curing agents that may be used include glycols such as ethylene glycol and 1,4-butanediol, triols such as glycerol and triethanolamine, polyhydric alcohols such as castor oil and sucrose, amine-based compounds such as β-aminoethyl alcohol, and diamine-based compounds such as diaminodiphenylmethane derivatives, aminobenzoates and aminothiophenol compounds.

Examples of crosslinking agents that may be used include polyhydric alcohols such as 1,4-butanediol, 1,5-pentanediol, 2,2-dimethyl-1,3-propanediol, and 3-methyl-1,5-pentanediol.

Examples of catalysts that may be used include amine-based catalysts such as triethylamine, N-ethylmorpholine, triethylenediamine, tetramethylhexamethylenediamine and tetramethylethylenediamine, as well as organometallic catalysts such as dibutyltin dilaurate, dioctyltin dilaurate and dibutyltin dimaleate. In those cases where a catalyst is not used, unreacted polymers may remain within the cleaning roller, and then bleed onto the charging roller in the regions where the rollers make contact, causing image defects.

Examples of foaming agents that may be used include water, carbon dioxide, fluorocarbons, formic acid and boric acid.

Examples of flame retardants that may be used include phosphate ester compounds such as trichloroethyl phosphate and trichloropropyl phosphate.

Examples of age resistors that may be used include antioxidants such as phenol-based antioxidants, amine-based antioxidants and phosphite-based antioxidants, ultraviolet absorbers such as benzotriazole-based ultraviolet absorbers and benzophenone-based ultraviolet absorbers, and photostabilizers such as hindered amine compounds.

Examples of foam regulators that may be used include silicone-based surfactants such as dimethyl silicone oil and polyether-modified silicone oil, as well as cationic surfactants, anionic surfactants and amphoteric surfactants.

Specific examples of the anionic surfactants include fatty acid soaps such as potassium laurate, sodium oleate, and sodium castor oil; sulfate esters such as octyl sulfate, lauryl sulfate, lauryl ether sulfate, and nonyl phenyl ether sulfate; sulfonate salts such as lauryl sulfonate, dodecyl sulfonate, dodecylbenzene sulfonate, sodium alkylnaphthalene sulfonates such as the triisopropylnaphthalene sulfonate and dibutylnaphthalene sulfonate, naphthalene sulfonate formalin condensate, monooctylsulfosuccinate, dioctylsulfosuccinate, lauric amide sulfonate, and oleic acid amide sulfonate; phosphate esters such as lauryl phosphate, isopropyl phosphate, and nonyl phenyl ether phosphate; and sulfosuccinate salts including sodium dialkylsulfosuccinates such as sodium dioctylsulfosuccinate, disodium lauryl sulfosuccinate, and disodium lauryl polyoxyethylene sulfosuccinate.

Specific examples of the cationic surfactants include amine salts such as laurylamine hydrochloride, stearylamine hydrochloride, oleylamine acetate, stearylamine acetate, and stearylaminopropylamine acetate; and quaternary ammonium salts such as lauryl trimethyl ammonium chloride, dilauryl dimethyl ammonium chloride, distearyl ammonium chloride, distearyl dimethyl ammonium chloride, lauryl dihydroxyethyl methyl ammonium chloride, oleyl bispolyoxyethylene methyl ammonium chloride, lauroylaminopropyl dimethyl ethyl ammonium ethosulfate, lauroylaminopropyl dimethyl hydroxyethyl ammonium perchlorate, alkyl benzene dimethyl ammonium chlorides, and alkyl trimethyl ammonium chlorides.

The no use of a silicone-based surfactant such as a typical dimethyl silicone oil or polyether-modified silicone oil as the urethane foam regulator is preferred.

Examples of conductive agents that may be used include carbon conductive agents such as Ketchen black, acetylene black, oil furnace black and thermal black, and ion-conductive agents that include ammonium compounds such as tetraethyl ammonium chloride and stearyl trimethyl ammonium chloride.

These additives may be used alone, or multiple additives may be used simultaneously.

<Method of Producing Charging Member Cleaning Unit>

There are no particular restrictions on the method of producing a charging member cleaning unit according to an exemplary embodiment of the present invention, although the method preferably includes forming an elastic layer, and removing amines from the elastic layer following formation, and the amine content within the elastic layer is preferably not more than approximately 60 ppm. In those cases where the charging member cleaning unit is a cleaning roller, the method includes, for example, forming an elastic layer around the outer periphery of a core, and removing amines from the elastic layer following formation.

Examples of the amine removal treatment include a heat treatment in which the elastic layer is subjected to heating following formation, and a reduced pressure treatment in which the elastic layer is subjected to a reduced pressure treatment following formation. A heat treatment is preferred as it offers a superior amine removal effect. Furthermore, in the heat treatment, there are no particular restrictions on the heating temperature, which may be set in accordance with the nature of the amine(s) contained within the elastic layer, although a temperature within a range from not less than approximately 80° C. to not more than approximately 160° C. is preferred. If the heating temperature is less than approximately 80° C., then the amine may not be able to be removed satisfactorily, whereas if the temperature exceeds approximately 160° C., then the material that constitutes the elastic layer, such as the polyurethane, may deform. The heating time in the heat treatment may be set in accordance with factors such as the heating temperature.

An example of a method of producing a polyurethane foam is presented below as an example of the method of producing a foam material for use as the elastic layer. A polyol and an isocyanate, together with other additives such as a conductive agent and crosslinking reaction catalyst, are mixed together almost uniformly, and by subsequently heating the mixture to effect reaction and curing, a polyurethane foam is obtained. Although there are no particular restrictions on the temperature or time employed during mixing of the raw materials, the mixing temperature is typically not less than approximately 10° C. and not more than approximately 90° C., and is preferably not less than approximately 20° C. and not more than approximately 60° C., whereas the mixing time is typically not less than approximately 10 seconds and not more than approximately 20 minutes, and is preferably not less than approximately 30 seconds and not more than approximately 5 minutes. Furthermore, during the heating to effect the reaction and curing, the polyurethane foam product can be obtained by using a conventional method to foam the product. There are no particular restrictions on the foaming method used, and any appropriate method may be used, including methods that employ a foaming agent, and methods that use mechanical stirring to introduce air bubbles.

The method of producing the foam product may employ either a method in which the urethane is injected into a mold and then foamed, or a method in which following slab molding, the foam is processed into the required shape by grinding or some other conventional technique.

Any method may be used for bonding the aforementioned core to the elastic foam product, provided the desired properties are achieved, although particularly desirable methods include a method in which the core is placed inside the mold in advance, and the foam-forming material is then injected into the mold around the core and subjected to foaming and curing, and a method in which the foam product is first prepared by foaming and curing, this foam product is then cut, and the core is then inserted inside the foam and bonded. In either of these methods, an adhesive layer may be provided between the core and the foam if required. Any material may be used for the adhesive layer, provided the desired properties are achieved, although adhesives such as conductive adhesives and hot-melt adhesives are particularly favorable.

A charging member cleaning unit according to an exemplary embodiment of the present invention may have either insulating or conductive properties. In the case of a conductive cleaning unit, the unit may also function as a charging member that charges the image holding member. Furthermore, in the case of a conductive cleaning unit, a cleaning bias may be applied to the unit. The meaning of the term "conductive" is deemed to also include "semiconductive".

There are no particular restrictions on the method used for imparting the charging member cleaning unit with conductivity, and possible methods include a method in which a conventional conductive agent is kneaded into the elastic layer, and a method in which a conductive powder is blown onto the elastic layer, although an impregnation method, in which the charging member cleaning unit is impregnated with a conductive coating material having an electrical resistance of not less than approximately $10^3\Omega$ and not more than approximately $10^{10}\Omega$ (and preferably not less than approximately $10^4\Omega$ and not more than approximately $10^8\Omega$), is preferred. By using an impregnation method, a charging member cleaning unit with an extremely stable electrical resistance can be obtained, and the costs can also be kept to an absolute minimum. Examples of the above conductive coating material include materials prepared by dispersing carbon within a urethane, silicon or styrene, and then dissolving the mixture in a solvent (such as ethyl acetate, toluene or methyl ethyl ketone).

<Charging Member Cleaning Device>

From the viewpoint of the cleaning properties achieved, the charging member cleaning unit according to an exemplary embodiment of the present invention is preferably rotationally driven against the charging member, and moreover, is preferably positioned so that it can be freely moved in and out of contact with the charging member. Such a configuration means that in those situations where cleaning is not necessary (for example, when the image forming apparatus is stopped for an long period of time), the charging member cleaning unit can be separated from the image holding member and the charging member and the like.

Specifically, as shown in FIG. 1, an elastic layer 14 of a cleaning roller 10 is preferably able to be brought freely into, and out of, contact with the surface of a charging roller 12 that functions as a roller-shaped cleaning target, and is preferably positioned so that it may move freely in and out along the axial direction of the charging roller 12. By adopting such a construction, the surface of the charging roller 12 can be cleaned substantially uniformly.

<Charging Device>

A charging device is described below. As described above, a contact charging system is preferably used as the charging system in order to reduce the film thickness of the photoreceptor, and this contact charging system is a system in which the surface of the photoreceptor is charged by applying a voltage to a conductive member that is in contact with the photoreceptor surface. The conductive member may be in the form of a brush, a blade, a pin electrode or a roller, and roller-shaped members are particularly desirable. A roller-shaped member is usually composed of a surface layer (a resistance layer), a conductive elastic layer (elastic layer) that supports the surface layer, and a conductive core. If required, a protective layer may also be provided on the outside of the surface layer.

A roller-shaped member can function as a charging device, and can be rotated at the almost same peripheral speed as the photoreceptor, even without a special drive unit, simply by bringing the member into contact with the photoreceptor. However, some form of drive unit may also be fitted to the roller member, and the roller may then be rotated at a different peripheral speed from the photoreceptor during charging.

The material for the conductive core is a material that exhibits conductivity, and typical examples include iron, copper, brass, stainless steel, aluminum and nickel. Furthermore, resin molded items containing conductive particles dispersed therein may also be used.

The material used for the conductive elastic layer is a conductive or semiconductive material, and is typically a rubber material with conductive particles or semiconductive particles dispersed therein. Examples of the rubber material include an ethylene-propylene-diene ternary copolymer rubber (EPDM), polybutadiene, natural rubber, polyisobutylene, styrene-butadiene rubber (SBR), chloroprene rubber (CR), nitrile rubber (NBR), silicone rubber, urethane rubber, epichlorohydrin rubber, styrene-butadiene-styrene block copolymer rubber (SBS), thermoplastic elastomer, norbornene rubber, fluorosilicone rubber or ethylene oxide rubber.

Examples of the conductive particles or semiconductive particles include carbon black, metals such as zinc, aluminum, copper, iron, nickel, chromium and titanium, and metal oxides such as $ZnO—Al_2O_3$, $SnO_2—Sb_2O_3$, $In_2O_3—SnO_2$, $ZnO—TiO_2$, $MgO—Al_2O_3$, $FeO—TiO_2$, $TiO_2$, $SnO_2$, $Sb_2O_3$, $In_2O_3$, ZnO and MgO. These materials may be used either alone, or in mixtures containing two or more different materials.

In an exemplary embodiment of the present invention, the conductive elastic layer preferably includes a polar polymer. This enables the effects provided by the charging member cleaning unit to manifest more favorably.

Furthermore, this polar polymer is preferably at least one polymer selected from amongst epichlorohydrin rubbers, epichlorohydrin-ethylene oxide copolymer rubbers, acrylonitrile butadiene rubbers, and urethane rubbers. Using such a polymer enables the effects provided by the charging member cleaning unit to manifest even more favorably.

Furthermore, the polar polymer preferably includes a quaternary ammonium salt as an ion-conductive agent. This enables the effects provided by the charging member cleaning unit to manifest even more favorably.

The material for the surface layer (the resistance layer) and the protective layer may be a material of controlled resistance prepared by dispersing conductive particles or semiconductive particles in a binder resin, and the resistivity for the material is typically not less than approximately $10^3$ Ωcm and not more than approximately $10^{14}$ Ωcm, is preferably not less than approximately $10^5$ Ωcm and not more than approximately $10^{12}$ Ωcm, and is even more preferably not less than approximately $10^7$ Ωcm and not more than approximately $10^{12}$ Ωcm.

The film thickness of the resistance layer and the protective layer is typically not less than approximately 0.01 μm and not more than approximately 1,000 μm, is preferably not less than approximately 0.1 μm and not more than approximately 500 μm, and is even more preferably not less than approximately 0.5 μm and not more than approximately 100 μm.

Examples of resins that can be used as the above binder resin include acrylic resins, cellulose resins, polyamide resins, methoxymethylated nylon, ethoxymethylated nylon, polyurethane resins, polycarbonate resins, polyester resins, polyethylene resins, polyvinyl resins, polyarylate resins, polythiophene resins, tetrafluoroethylene-perfluoroalkoxyethylene copolymers (PFA), tetrafluoroethylene-hexafluoropropylene copolymers (FEP), polyolefin resins such as polyethylene terephthalate (PET), and styrene-butadiene resins. Of these, in terms of achieving a better manifestation of the effects provided by the charging member cleaning unit, the binder resin is preferably at least one resin selected from amongst polyamide resins, polyester resins, polyurethane resins and acrylic resins. Furthermore, in terms of achieving particularly superior effects for the charging member cleaning unit, the binder resin is most preferably a polyamide resin, and the polyamide resin is preferably at least one of an alcohol-soluble copolymer nylon and an N-methoxymethylated nylon.

The conductive particles or semiconductive particles can employ the same carbon blacks, metals or metal oxides as those described above for the conductive elastic layer. Furthermore, other additives may also be added as required, including antioxidants such as hindered phenols or hindered amines, fillers such as clay or kaolin, and lubricants such as silicone oils.

Examples of methods that may be used for forming these layers include blade coating, Meyer bar coating, spray coating, dip coating, bead coating, air knife coating and curtain coating methods.

In order to charge the photoreceptor using these conductive members, a voltage is applied to the conductive member, and this voltage is preferably either a direct current voltage, or a voltage obtained by superimposing a direct current voltage and an alternating current voltage. In the case of a direct current voltage, the voltage is preferably set in accordance with the required photoreceptor potential, to either a positive or negative voltage of not less than approximately 50 V and not more than approximately 2,000 V, and a voltage of not less than approximately 100 V and not more than approximately 1,500 V is particularly desirable. In those cases where an alternating current is superimposed, the peak to peak voltage is preferably not less than approximately 400 V and not more than approximately 1,800 V, is more preferably not less than approximately 800 V and not more than approximately 1,600 V, and is most preferably not less than approximately 1,200 V and not more than approximately 1,600 V. The frequency of the alternating current voltage is preferably not less than approximately 50 Hz and not more than approximately 20,000 Hz, and is even more preferably not less than approximately 100 Hz and not more than approximately 5,000 Hz.

<Image Forming Apparatus and Process Cartridge>

Figure 2:
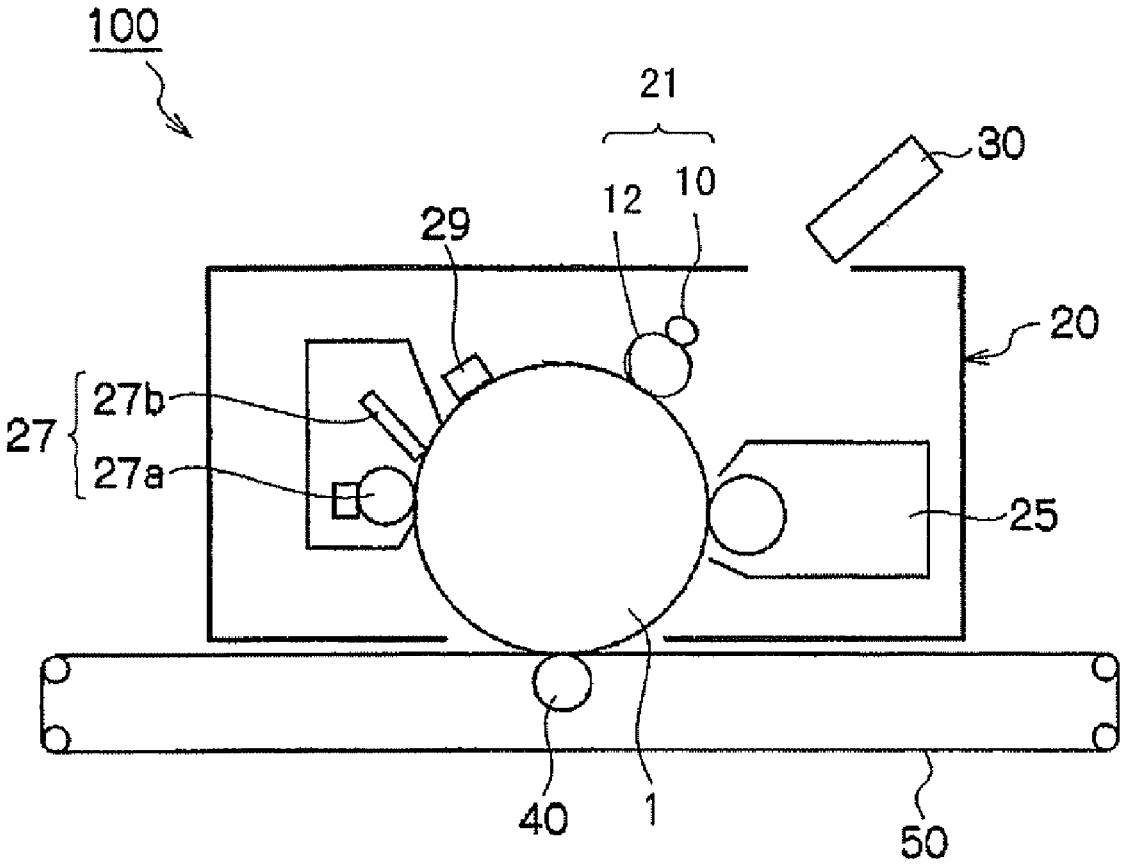
FIG. 2 is a schematic illustration showing an example of an image forming apparatus according to an exemplary embodiment of the present invention.

FIG. 2 is a schematic illustration showing an example of an image forming apparatus according to an exemplary embodiment of the present invention. The image forming apparatus 100 shown in FIG. 2 has an image forming apparatus main casing (not shown in the figure) which is equipped with a process cartridge 20 that contains at least a charging device 21, an exposure device 30 that functions as a latent image forming unit, a transfer device 40 that functions as a transfer unit, and an intermediate transfer member 50. In the image forming apparatus 100, the exposure device 30 is positioned in a location that enables exposure of an electrophotographic photoreceptor 1 (the image holding member) through an opening in the process cartridge 20, the transfer device 40 is positioned so as to oppose the electrophotographic photoreceptor 1 across the intermediate transfer member 50, and the intermediate transfer member 50 is positioned so that a section of the member makes contact with the electrophotographic photoreceptor 1.

Inside the casing of the process cartridge 20, the charging device 21, the electrophotographic photoreceptor 1, a developing device 25 that functions as the developing unit, a cleaning device 27, and a fibrous member (in the shape of a flat brush) 29 are integrated together using mounting rails. The casing includes an opening through which exposure is conducted.

The charging device described above can be used as the charging device 21. As described above, this charging device 21 includes a charging roller 12 and a cleaning roller 10.

Figure 11:
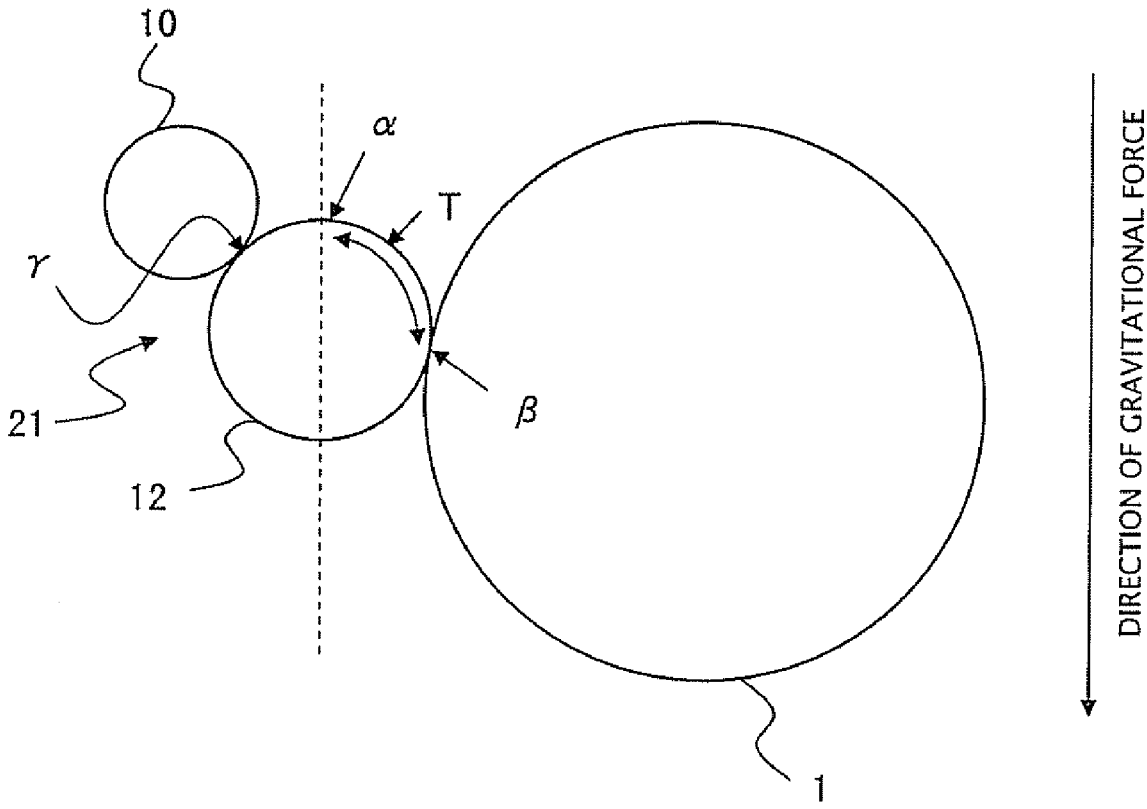
FIG. 11 is a schematic illustration describing the positional placements of a charging member cleaning roller and a charging roller.

The cleaning roller 10 is preferably arranged so as to contact the charging roller 12 under the conditions described below. As shown in FIG. 11, within a cross-section orthogonal to the axes of the charging roller 12, the cleaning roller 10 and the electrophotographic photoreceptor 1, if a line is drawn through the axis point of the charging roller 12 in a direction parallel to the direction of gravitational force (the dotted line in FIG. 11), and of the two points of intersection between this line and the outer periphery of the charging roller 12, the point that is higher than the axis point of the charging roller 12 in the direction of gravitational force is termed α, and if the position of contact between the charging roller 12 and the electrophotographic photoreceptor 1 is termed β, then the cleaning roller 10 is preferably positioned so that the contact point γ between the cleaning roller 10 and the charging roller 12 is positioned other than within an outer peripheral region T of the charging roller 12 that is located closer to the electrophotographic photoreceptor 1 than the axis point of the charging roller 12, between the point α and the point β.

By positioning the cleaning roller 10 in this manner, foreign matter that drops off the cleaning roller 10 is prevented from falling onto the charging roller 12 or the electrophotographic photoreceptor 1. As a result, charging faults of the electrophotographic photoreceptor 1 caused by such foreign matter can be suppressed, meaning the occurrence of color spots on the resulting image can be prevented, and enabling image quality problems to be prevented over long periods of time.

Figure 6:
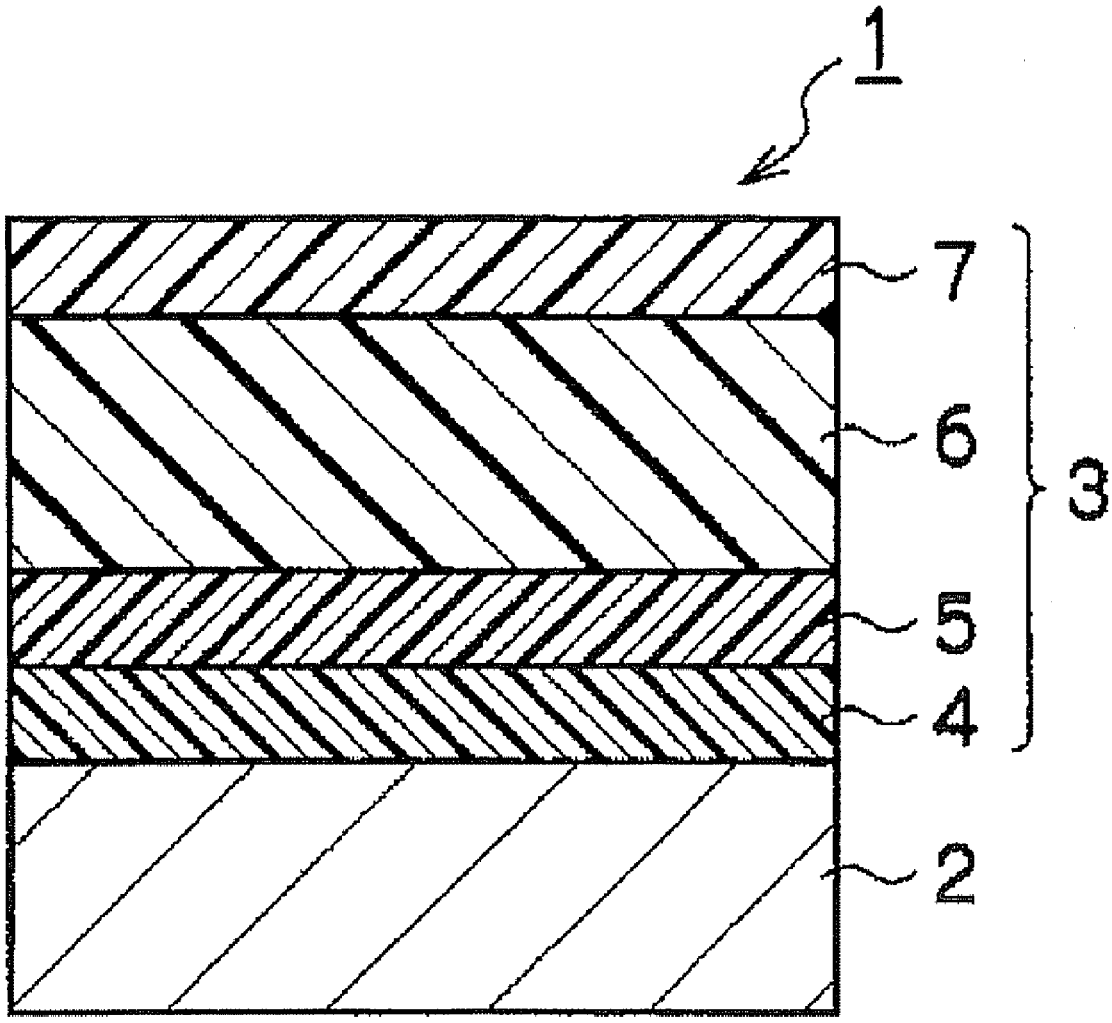
FIG. 6 is a schematic cross-sectional view showing an example of an electrophotographic photoreceptor according to an exemplary embodiment of the present invention.

Next is a description of the electrophotographic photoreceptor 1. FIG. 6 is a schematic cross-sectional view showing an example of the electrophotographic photoreceptor used in an image forming apparatus according to an exemplary embodiment of the present invention. The electrophotographic photoreceptor 1 shown in FIG. 6 is composed of a conductive support 2 and a photosensitive layer 3. The photosensitive layer 3 has a structure in which an undercoat layer 4, a charge generation layer 5, a charge transport layer 6 and a protective layer 7 are laminated sequentially, in that order, on top of the conductive support 2.

Figure 7:
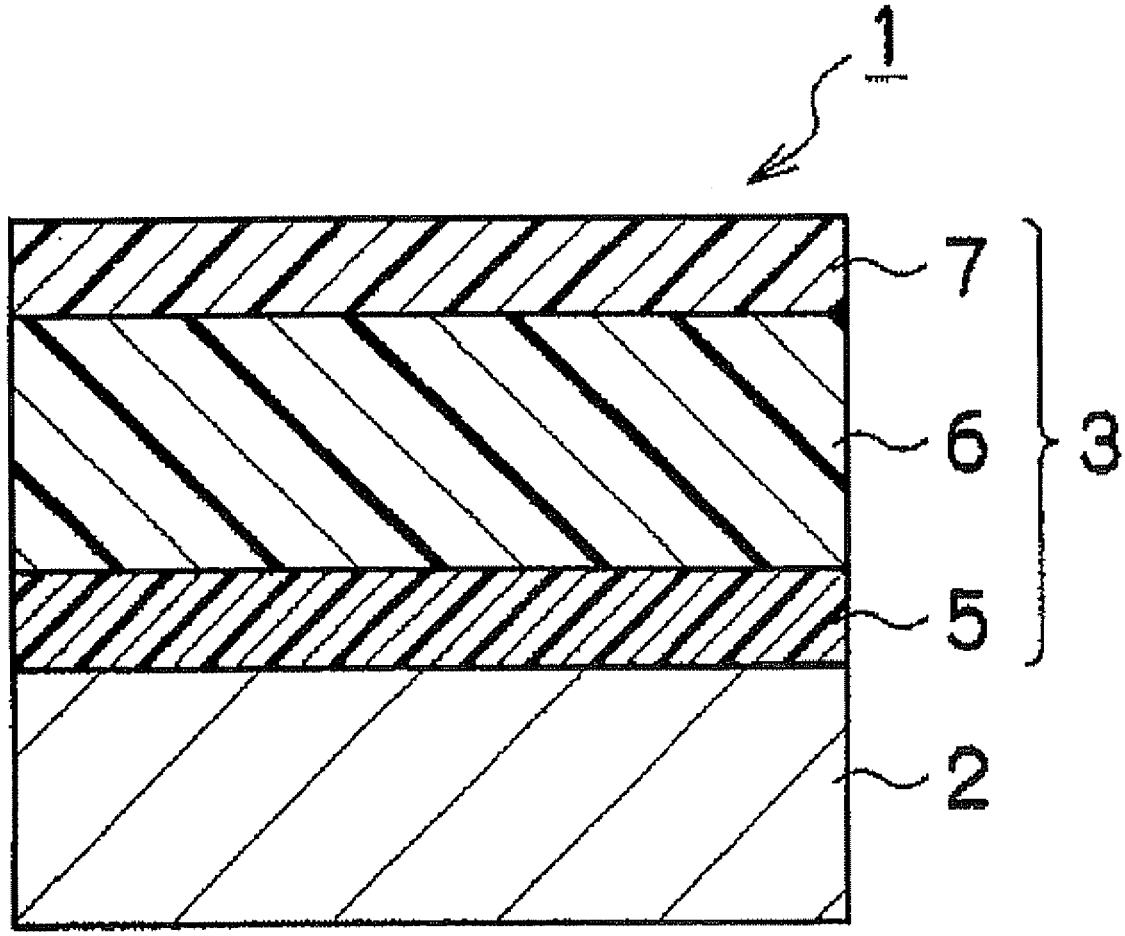
FIG. 7 is a schematic cross-sectional view showing another example of an electrophotographic photoreceptor according to an exemplary embodiment of the present invention.
Figure 8:
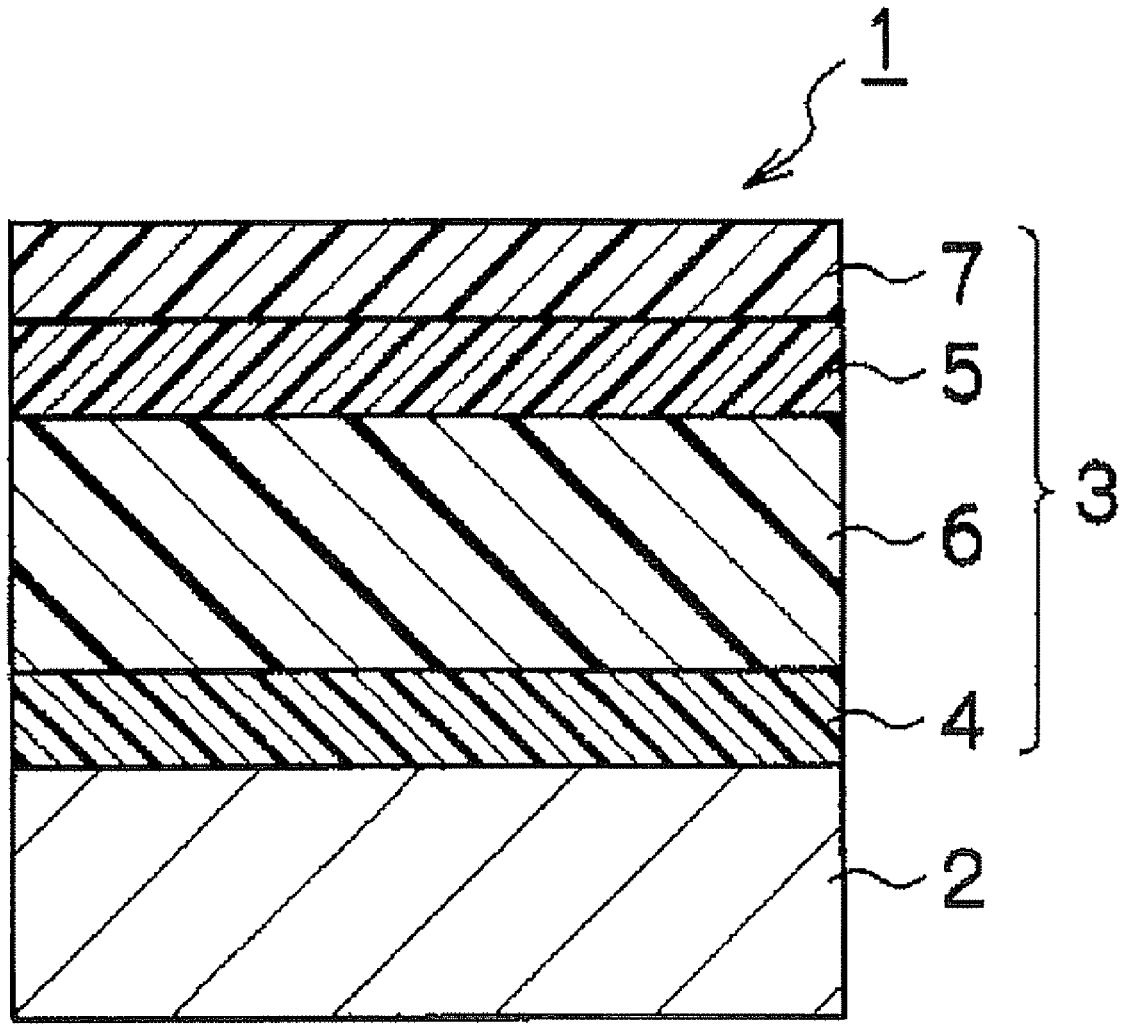
FIG. 8 is a schematic cross-sectional view showing yet another example of an electrophotographic photoreceptor according to an exemplary embodiment of the present invention.
Figure 9:
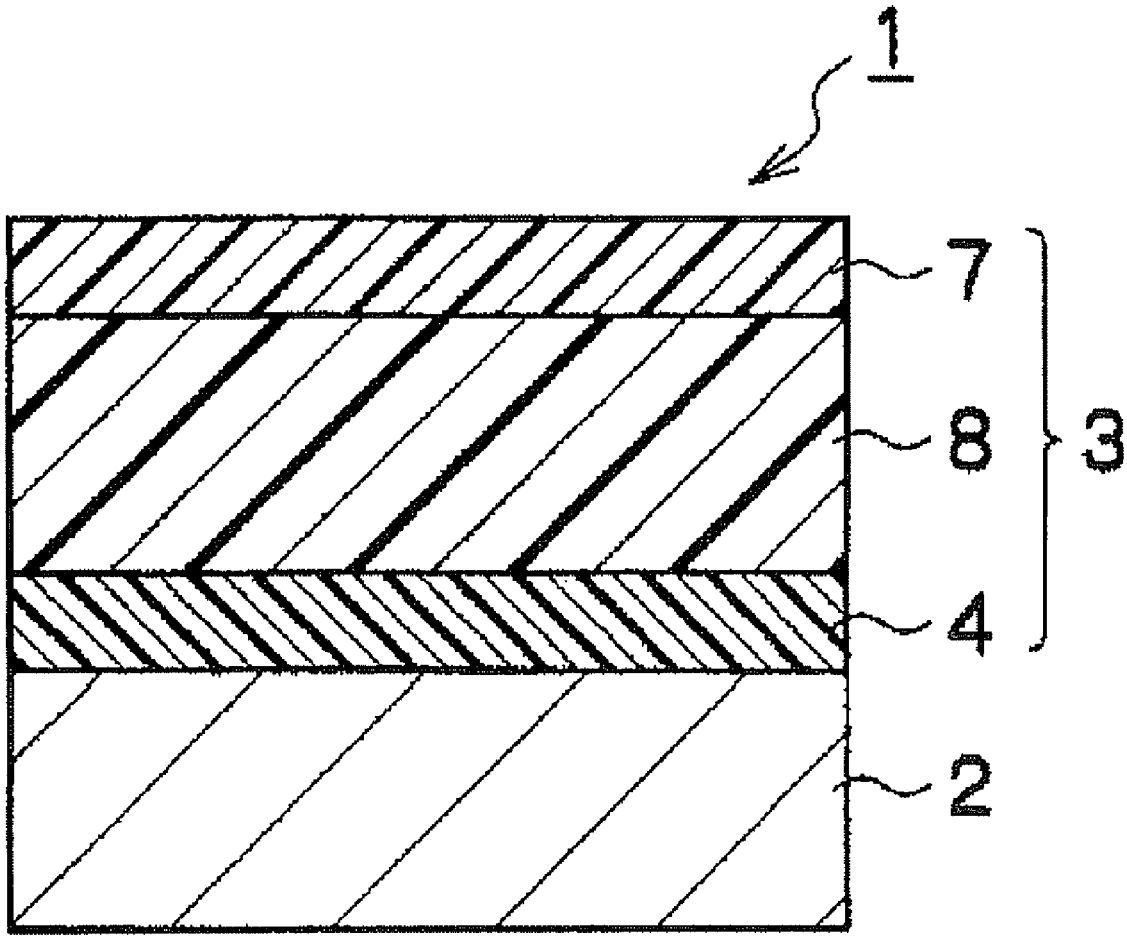
FIG. 9 is a schematic cross-sectional view showing yet another example of an electrophotographic photoreceptor according to an exemplary embodiment of the present invention.
Figure 10:
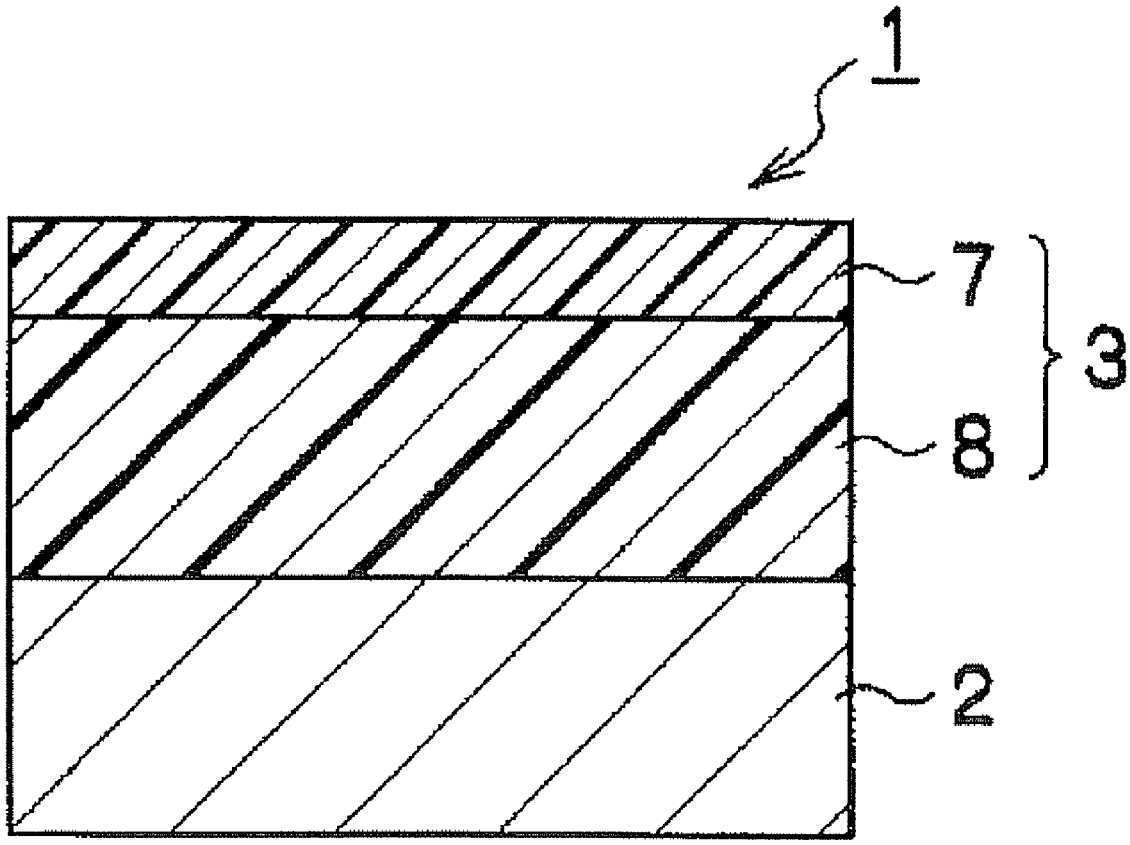
FIG. 10 is a schematic cross-sectional view showing yet another example of an electrophotographic photoreceptor according to an exemplary embodiment of the present invention.

Furthermore, FIG. 7 through FIG. 10 are schematic cross-sectional views showing other examples of electrophotographic photoreceptors. The electrophotographic photoreceptors shown in FIG. 7 and FIG. 8 are both provided with a photosensitive layer 3 in which the functions are split between the charge generation layer and the charge transport layer 6, in a similar manner to the electrophotographic photoreceptor shown in FIG. 6. In FIG. 9 and FIG. 10, the charge generation material and the charge transport material are incorporated within a single layer (a single-layer photosensitive layer 8).

The electrophotographic photoreceptor 1 shown in FIG. 7 has a structure in which the charge generation layer 5, the charge transport layer 6, and the protective layer 7 are laminated sequentially on top of the conductive support 2. Furthermore, the electrophotographic photoreceptor 1 shown in FIG. 8 has a structure in which the undercoat layer 4, the charge transport layer 6, the charge generation layer 5, and the protective layer 7 are laminated sequentially on top of the conductive support 2.

The electrophotographic photoreceptor 1 shown in FIG. 9 has a structure in which the undercoat layer 4, the single-layer photosensitive layer 8, and the protective layer 7 are laminated sequentially on top of the conductive support 2. Furthermore, the electrophotographic photoreceptor 1 shown in FIG. 10 has a structure in which the single-layer photosensitive layer 8 and the protective layer 7 are laminated sequentially on top of the conductive support 2.

In the electrophotographic photoreceptors shown in FIG. 6 through FIG. 10, the undercoat layer 4 may not necessarily be provided.

The photosensitive layer of the electrophotographic photoreceptor 1 may be either a single-layer photosensitive layer in which the charge generation material and the charge transport material are incorporated within a single layer, or a function-separated photosensitive layer in which a layer containing the charge generation material (the charge generation layer) and a layer containing the charge transport material (the charge transport layer) are provided separately. In the case of a function-separated photosensitive layer, the lamination sequence of the charge generation layer and the charge transport layer may be altered so that either of the two layers may exist on top. Moreover, in the case of a function-separated photosensitive layer, because the functions can be clearly separated with each layer needing to perform its particular function, a higher level of functionality can generally be achieved.

There are no particular restrictions on the electrophotographic photoreceptor 1, and conventional photoreceptors may be used. Each of the elements of the photoreceptor is described below, using the electrophotographic photoreceptor 1 shown in FIG. 6 as a representative example.

Examples of the conductive support 2 include a metal plate, a metal drum or a metal belt formed using a metal such as aluminum, copper, zinc, stainless steel, chromium, nickel, molybdenum, vanadium, indium, gold or platinum, or an alloy thereof. Further examples of the conductive support 2 include papers, plastic films or belts or the like onto which conductive compounds such as conductive polymers and indium oxide or a metal such as aluminum, palladium or gold, or an alloy thereof, has been applied, deposited or laminated.

In order to prevent interference fringes from developing during irradiation of the laser light, the surface of the conductive support 2 is preferably roughened so that the center line average roughness (Ra) is not less than approximately 0.04 μm and not more than approximately 0.5 μm. If the center line average roughness (Ra) of the surface of the conductive support 2 is less than approximately 0.04 μm, then the surface may approaches mirror-like surface, and the interference prevention effect may tend to be unsatisfactory. In contrast, if the center line average roughness (Ra) exceeds approximately 0.5 μm, then even with a coating formed thereon, the image quality may tend to be unsatisfactory. In those cases where noninterference light is used as the light source, the above surface roughening for preventing interference fringes is not particularly necessary, and because this means defects caused by unevenness on the surface of the conductive support 2 can be prevented, the lifespan of the support can be extended.

Preferred methods of conducting the surface roughening include wet honing, which is conducted by spraying a suspension of an abrasive in water onto the support, centerless grinding, in which the support is pressed onto a rotating grindstone and subjected to a continuous grinding treatment, or an anodization treatment or the like.

Another roughening treatment that can be used favorably is a method in which the surface of the conductive support 2 itself is not roughened, but rather, a conductive or semiconductive powder is dispersed within a resin, and this resin is then used to form a layer on the surface of the support, with the particles dispersed within the layer causing a roughening of the surface.

In the above anodization treatment, anodization is conducted in an electrolyte solution using aluminum as an anode, thereby forming an oxide film on the surface of the aluminum. Examples of the electrolyte solution include a sulfuric acid solution or an oxalic acid solution. However, the resulting porous anodized film may be chemically active, easily contaminated, and exhibit large fluctuations in resistance depending on the environment. Consequently, fine pores within the anodized film may be blocked by conducting a sealing treatment, in which volume expansion using a hydration reaction within pressurized water vapor or boiling water (a metal salt such as a nickel salt may also be added) can be used to seal the pores and convert the film to a more stable hydrated oxide.

The film thickness of the anodized film is preferably not less than approximately 0.3 μm and not more than approximately 15 μm. If this film thickness is less than approximately 0.3 μm, then the barrier properties to injection may be be poor, and the effects of the film may tend to be insufficient. In contrast, a film thickness that exceeds 15 μm may tend to invite an increase in residual potential upon repeated use.

Furthermore, the conductive support 2 may also be subjected to a treatment using an aqueous acidic solution, or to a boehmite treatment. Treatment using an acidic treatment solution containing phosphoric acid, chromic acid and hydrofluoric acid is conducted in the following manner. First, the acidic treatment solution is prepared. The blend proportions of the phosphoric acid, chromic acid and hydrofluoric acid within the acidic treatment solution are not less than approximately 10% by mass and not more than approximately 11% by mass for the phosphoric acid, not less than approximately 3% by mass and not more than approximately 5% by mass for the chromic acid, and not less than approximately 0.5% by mass and not more than approximately 2% by mass for the hydrofluoric acid, and the total acid concentration within the solution is preferably not less than approximately 13.5% by mass and not more than approximately 18% by mass. The treatment temperature is preferably not less than approximately 42° C. and not more than approximately 48° C., and a thicker coating can be formed more rapidly by keeping the treating temperature high. The film thickness of the coating is preferably not less than approximately 0.3 μm and not more than approximately 15 μm. If the film thickness is less than 0.3 μm, then the barrier properties to injection are poor, and the effects of the coating may tend to be insufficient. In contrast, a film thickness that exceeds 15 μm may tend to invite an increase in residual potential upon repeated use.

Boehmite treatment can be conducted by immersing the support in pure water of not less than approximately 90° C. and not more than approximately 100° C. for a period of not less than approximately 5 minutes and not more than approximately 60 minutes, or by bringing the support into contact with heated water vapor of not less than approximately 90° C. and not more than approximately 120° C. for a period of not less than approximately 5 minutes and not more than approximately 60 minutes. The film thickness of the coating is preferably not less than approximately 0.1 μm and not more than approximately 5 μm. This coating may be further anodized using an electrolyte solution that exhibits low solubility of the coating, such as a solution of adipic acid, boric acid, or a borate, phosphate, phthalate, maleate, benzoate, tartrate or citrate.

The undercoat layer 4 can be formed on top of the conductive support 2. The undercoat layer 4 contains, for example, at least one of an organometallic compound and a binder resin.

Examples of the organometallic compound include organozirconium compounds such as zirconium chelate compounds, zirconium alkoxide compounds and zirconium coupling agents, organotitanium compounds such as titanium chelate compounds, titanium alkoxide compounds and titanate coupling agents, organoaluminum compounds such as aluminum chelate compounds and aluminum coupling agents, as well as antimony alkoxide compounds, germanium alkoxide compounds, indium alkoxide compounds, indium chelate compounds, manganese alkoxide compounds, manganese chelate compounds, tin alkoxide compounds, tin chelate compounds, aluminum silicon alkoxide compounds, aluminum titanium alkoxide compounds, and aluminum zirconium alkoxide compounds.

Use of an organozirconium compound, organotitanium compound or organoaluminum compound as the organometallic compound is particularly preferred, because these compounds may exhibit low residual potential as well as excellent electrophotographic properties.

Examples of the binder resin include conventional resins such as polyvinyl alcohol, polyvinyl methyl ether, poly-N-vinylimidazole, polyethylene oxide, ethyl cellulose, methyl cellulose, ethylene-acrylic acid copolymers, polyamides, polyimides, casein, gelatin, polyethylene, polyesters, phenolic resins, vinyl chloride-vinyl acetate copolymers, epoxy resins, polyvinylpyrrolidone, polyvinylpyridine, polyurethanes, polyglutamic acid and polyacrylic acid. If a combination of two or more of these binder resins is used, then the mixing ratio may be set appropriately according to need.

Further, the undercoat layer 4 may also include a silane coupling agent such as vinyltrichlorosilane, vinyltrimethoxysilane, vinyltriethoxysilane, vinyltris-2-methoxyethoxysilane, vinyltriacetoxysilane, γ-glycidoxypropyltrimethoxysilane, γ-methacryloxypropyltrimethoxysilane, γ-aminopropyltriethoxysilane, γ-chloropropyltrimethoxysilane, γ-2-aminoethylaminopropyltrimethoxysilane, γ-mercaptopropyltrimethoxysilane, γ-ureidopropyltriethoxysilane, and β-3,4-epoxycyclohexyltrimethoxysilane.

Furthermore, from the viewpoints of achieving a low residual potential and favorable environmental stability, an electron transport pigment may also be mixed or dispersed within the undercoat layer 4. Examples of this electron transport pigment include organic pigments such as the perylene pigments described in JP 47-30330 A, bisbenzimidazole perylene pigments, polycyclic quinone pigments, indigo pigments and quinacridone pigments, organic pigments such as bisazo pigments and phthalocyanine pigments containing an electron-withdrawing substituent group such as a cyano group, nitro group, nitroso group or a halogen atom, and inorganic pigments such as zinc oxide and titanium oxide.

Of these pigments, perylene pigments, bisbenzimidazole perylene pigments, polycyclic quinone pigments, zinc oxide and titanium oxide are preferred, as they may exhibit high electron mobility.

Furthermore, in order to better control the dispersibility and charge transport properties, the surfaces of these pigments may be treated with an aforementioned coupling agent or binder resin or the like.

If the quantity of the electron transport pigment is too large, then the strength of the undercoat layer 4 may tend to deteriorate, which can cause coating defects. Accordingly, the quantity of the pigment, relative to the total mass of the solid fraction of the undercoat layer 4, is preferably not more than approximately 95% by mass, and is even more preferably approximately 90% by mass or less.

Fine powders of various organic compounds or inorganic compounds are preferably added to the undercoat layer 4 to improve properties such as the electrical properties and the light scattering properties. Examples of compounds that are particularly effective include white pigments such as titanium oxide, zinc oxide, Chinese white, zinc sulfide, lead white and lithopone, inorganic pigments that function as extender pigments such as alumina, calcium carbonate and barium sulfate, as well as polytetrafluoroethylene resin particles, benzoguanamine resin particles and styrene resin particles.

The volume average particle size of the added fine powder is preferably not less than approximately 0.01 μm and not more than approximately 2 μm. These fine powders may be added according to need, and the quantity added, relative to the total mass of the solid fraction of the undercoat layer 4 is preferably not less than approximately 10% by mass and more than approximately 90% by mass, and is even more preferably not less than approximately 30% by mass and not more than approximately 80% by mass.

The undercoat layer 4 can be formed using an undercoat layer-forming coating liquid containing each of the component materials described above. The solvent used in the undercoat layer-forming coating liquid may use any solvent that dissolves the organometallic compound or the binder resin, and does not cause gelation or coagulation when the electron transport pigment is mixed and/or dispersed within the liquid.

Specific examples of the organic solvent include conventional organic solvents such as methanol, ethanol, n-propanol, n-butanol, benzyl alcohol, methyl cellosolve, ethyl cellosolve, acetone, methyl ethyl ketone, cyclohexanone, methyl acetate, n-butyl acetate, dioxane, tetrahydrofuran, methylene chloride, chloroform, chlorobenzene and toluene. These solvents may be used either alone or as a mixture containing two or more different solvents.

The mixing or dispersing of the component materials can be conducted by a conventional method using a ball mill, roll mill, sand mill, attritor, vibrating ball mill, colloid mill or paint shaker, or using ultrasonic mixing. The mixing and/or dispersion is conducted within the organic solvent.

The coating method used for forming the undercoat layer 4 may employ conventional methods such as blade coating, wire bar coating, spray coating, dip coating, bead coating, air knife coating or curtain coating methods.

Drying of the coating liquid is usually conducted at a temperature that evaporates the solvent and enables formation of a coating film. Particularly in those cases where the conductive support 2 has undergone an acidic solution treatment or a boehmite treatment, the ability of the support to block defects may tend to be inadequate, and therefore formation of an undercoat layer 4 is desirable.

The film thickness of the undercoat layer 4 is preferably not less than approximately 0.01 μm and not more than approximately 30 μm, and is even more preferably not less than approximately 0.05 μm and not more than approximately 25 μm.

The charge generation layer 5 contains a charge generation material, and if required, a binder resin.

The charge generation material can use conventional materials, including organic pigments that include azo pigments such as bisazo and trisazo pigments, condensed-ring aromatic pigments such as dibromoanthanthrone, perylene pigments, pyrrolopyrrole pigments and phthalocyanine pigments, and inorganic pigments such as trigonal selenium and zinc oxide. In those cases where an exposure wavelength of not shorter than approximately 380 nm and not longer than approximately 500 nm is used as the light source, the charge generation material is preferably a metallic or non-metallic phthalocyanine pigment, trigonal selenium, or dibromoanthanthrone or the like. Of these possibilities, hydroxygallium phthalocyanine disclosed in JP 05-263007 A and JP 05-279591 A, chlorogallium phthalocyanine disclosed in JP 05-98181 A, dichlorotin phthalocyanine disclosed in JP 05-140472 A and JP 05-140473 A, and titanyl phthalocyanine disclosed in JP 04-189873 A and JP 05-43813 A are particularly preferred.

Furthermore, of the above hydroxygallium phthalocyanine pigments, those having an absorption maximum within a spectroscopic absorption spectrum of not less than approximately 810 nm and not more than approximately 839 nm, a primary particle size that is not more than approximately 0.10 μm, and a specific surface area as measured by the BET method of not less than approximately 45 $m^2/g$ are particularly desirable.

The binder resin may be selected from a broad range of insulating resins. Further, the binder resin may also be selected from amongst organic photoconductive polymers such as poly-N-vinylcarbazole, polyvinylanthracene, polyvinylpyrene and polysilane. Preferred examples of the binder resin include insulating resins such as polyvinyl butyral resins, polyarylate resins (such as polycondensates of bisphenol A and phthalic acid), polycarbonate resins, polyester resins, phenoxy resins, vinyl chloride-vinyl acetate copolymers, polyamide resins, acrylic resins, polyacrylamide resins, polyvinylpyridine resins, cellulose resins, urethane resins, epoxy resins, casein, polyvinyl alcohol resins, and polyvinylpyrrolidone resins, although this is not an exhaustive list. These binder resins may be used either alone or in mixtures containing two or more different resins.

The charge generation layer 5 can be formed either by vapor deposition of the charge generation material, or by application of a charge generation layer-forming coating liquid containing the charge generation material and a binder resin. In those cases where the charge generation layer 5 can be formed using a charge generation layer-forming coating liquid, the blend ratio (mass ratio) between the charge generation material and the binder resin is preferably within a range from approximately 10:1 to approximately 1:10.

Examples of methods that may be used for dispersing each of the above component materials within the charge generation layer-forming coating liquid include typical methods such as a ball mill dispersion method, attritor dispersion method, or sand mill dispersion method. During this method, the conditions can be selected so that the dispersion does not alter the crystal type of the pigment. Moreover, the dispersion preferably yields a particle size that is not more than approximately 0.5 μm, even more preferably not more than approximately 0.3 μm, and most preferably approximately 0.15 μm or less.

Examples of solvents that may be used in the dispersion include typical organic solvents such as methanol, ethanol, n-propanol, n-butanol, benzyl alcohol, methyl cellosolve, ethyl cellosolve, acetone, methyl ethyl ketone, cyclohexanone, methyl acetate, n-butyl acetate, dioxane, tetrahydrofuran, methylene chloride, chloroform, chlorobenzene and toluene. These solvents may be used either alone, or in mixtures of two or more different solvents.

When the charge generation layer 5 is formed using a charge generation layer-forming coating liquid, typical methods may be used for forming the layer, including blade coating, wire bar coating, spray coating, dip coating, bead coating, air knife coating and curtain coating methods.

The film thickness of the charge generation layer 5 is preferably not less than approximately 0.1 μm and not more than approximately 5 μm, and is even more preferably not less than approximately 0.2 μm and not more than approximately 2.0 μm.

The charge transport layer 6 contains either a charge transport material and a binder resin, or a polymer charge transport material.

There are no particular restrictions on the charge transport material, and examples include electron transport compounds, including quinone-based compounds such as p-benzoquinone, chloranil, bromanil and anthraquinone, fluorenone compounds such as tetracyanoquinodimethane-based compounds and 2,4,7-trinitrofluorenone, xanthone-based compounds, benzophenone-based compounds, cyanovinyl-based compounds and ethylene-based compounds; and positive hole transport compounds such as triarylamine-based compounds, benzidine-based compounds, arylalkane-based compounds, aryl-substituted ethylene-based compounds, stilbene-based compounds, anthracene-based compounds, and hydrazone-based compounds. These charge transport materials may be used either alone or within mixtures containing two or more different materials.

From the viewpoint of mobility, compounds represented by the general formulas (a-1), (a-2) and (a-3) are preferred as the charge transport material.

(a-1)

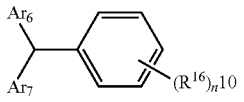

In the above formula (a-1), $R^{16}$ represents a hydrogen atom or a methyl group, and n10 represents either 1 or 2. Further, $Ar_6$ and $Ar_7$ each represent, independently, a substituted or unsubstituted aryl group, a $—C_6H_4—C(R^{38})=C(R^{39})(R^{40})$ group, or a $C_6H_4—CH=CH—CH=C(Ar)_2$ group, wherein examples of the substituents include a halogen atom, an alkyl group of 1 to 5 carbon atoms, an alkoxy group of 1 to 5 carbon atoms, or a substituted amino group substituted with an alkyl group of 1 to 3 carbon atoms. $R^{38}$, $R^{39}$ and $R^{40}$ each represent a hydrogen atom, a substituted or unsubstituted alkyl group or a substituted or unsubstituted aryl group, and Ar represents a substituted or unsubstituted aryl group.

(a-2)

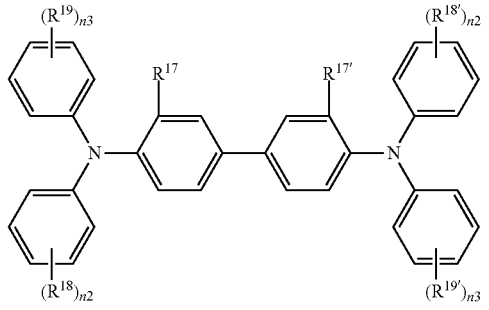

In the above formula (a-2), $R^{17}$ and $R^{17'}$ each represent, independently, a hydrogen atom, a halogen atom, an alkyl group of 1 to 5 carbon atoms, or an alkoxy group of 1 to 5 carbon atoms, $R^{18}$, $R^{18'}$, $R^{19}$ and $R^{19'}$ each represent, independently, a halogen atom, an alkyl group of 1 to 5 carbon atoms, an alkoxy group of 1 to 5 carbon atoms, an amino group substituted with an alkyl group of 1 to 2 carbon atoms, a substituted or unsubstituted aryl group, a —C($R^{38}$)═C($R^{39}$)($R^{40}$) group, or a —CH═CH—CH═C(Ar)$_2$ group, wherein $R^{38}$, $R^{39}$ and $R^{40}$ each represent a hydrogen atom, a substituted or unsubstituted alkyl group or a substituted or unsubstituted aryl group, and Ar represents a substituted or unsubstituted aryl group. Furthermore, n2 and n3 each represent, independently, an integer of 0 to 2.

phenol-formaldehyde resins, and styrene-alkyd resins. These binder resins may be used either alone, or in mixtures containing two or more different resins. The blend ratio (mass ratio) between the charge transport material and the binder resin is preferably within a range from approximately 10:1 to approximately 1:5.

Furthermore, examples of materials that can be used as polymer charge transport materials include conventional materials having charge transport properties, such as poly-N-vinylcarbazoles and polysilanes and the like. The polyester-based polymer charge transport materials disclosed in JP 08-176293 A and JP 08-208820 A are particularly desirable as they may exhibit superior charge transport properties.

These polymer charge transport materials may be used as the sole component material for the charge transport layer 6, or may also be mixed with an aforementioned binder resin prior to film formation.

The charge transport layer 6 can be formed using a charge transport layer-forming coating liquid that contains the component materials described above. Examples of the solvent used in the charge transport layer-forming coating liquid include conventional organic solvents, including aromatic hydrocarbons such as benzene, toluene, xylene and chlorobenzene, ketones such as acetone and 2-butanone, halogenated aliphatic hydrocarbons such as methylene chloride, chloroform and ethylene chloride, and cyclic or straight-chain ethers such as tetrahydrofuran and ethyl ether. These solvents may be used either alone, or in mixtures of two or more different solvents.

(a-3)

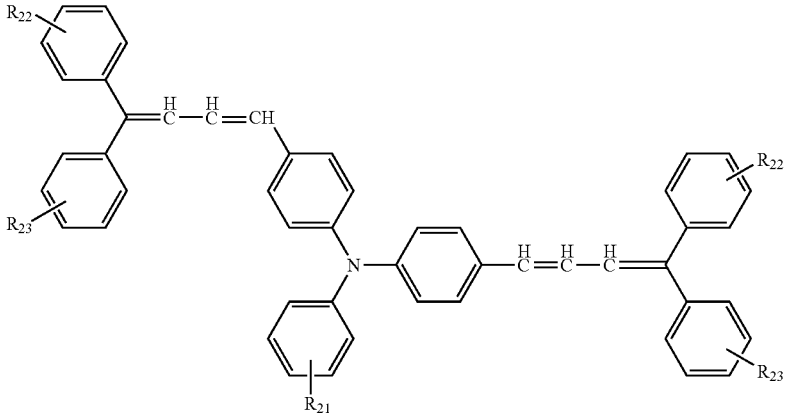

In the above formula (a-3), $R_{21}$ represents a hydrogen atom, an alkyl group of 1 to 5 carbon atoms, an alkoxy group of 1 to 5 carbon atoms, a substituted or unsubstituted aryl group, or a —CH═CH—CH═C(Ar)$_2$ group. Ar represents a substituted or unsubstituted aryl group. $R_{22}$ and $R_{23}$ each represent, independently, a hydrogen atom, a halogen atom, an alkyl group of 1 to 5 carbon atoms, an alkoxy group of 1 to 5 carbon atoms, an amino group substituted with an alkyl group of 1 to 2 carbon atoms, or a substituted or unsubstituted aryl group.

Examples of the binder resin used in the charge transport layer 6 include polycarbonate resins, polyester resins, methacrylic resins, acrylic resins, polyvinyl chloride resins, polyvinylidene chloride resins, polystyrene resins, polyvinyl acetate resins, styrene-butadiene copolymers, vinylidene chloride-acrylonitrile copolymers, vinyl chloride-vinyl acetate copolymers, vinyl chloride-vinyl acetate-maleic anhydride copolymers, silicone resins, silicone-alkyd resins, The coating method used for applying the charge transport layer-forming coating liquid may employ conventional methods such as blade coating, wire bar coating, spray coating, dip coating, bead coating, air knife coating or curtain coating methods.

The film thickness of the charge transport layer 6 is preferably not less than approximately 5 μm and not more than approximately 50 μm, and is even more preferably not less than approximately 10 μm and not more than approximately 30 μm.

In order to prevent degradation of the photoreceptor either by ozone or acidic gases generated within the image forming apparatus, or by light or heat, additives such as antioxidants, photostabilizers and heat stabilizers may also be added to the photosensitive layer 3.

Examples of antioxidants include hindered phenols, hindered amines, paraphenylenediamine, arylalkanes, hydroquinone, spirochromans, spiroindanone and derivatives thereof, organic sulfur compounds, and organic phosphorus compounds. Examples of photostabilizers include benzophenones, benzotriazoles, dithiocarbamates, and tetramethylpiperidines.

Furthermore, in order to improve the sensitivity, reduce the residual potential, reduce the fatigue associated with repeated use or the like, the photosensitive layer 3 may also include at least one type of electron-accepting substance.

Examples of this electron-accepting substance include succinic anhydride, maleic anhydride, dibromosuccinic anhydride, phthalic anhydride, tetrabromophthalic anhydride, tetracyanoethylene, tetracyanoquinodimethane, o-dinitrobenzene, m-dinitrobenzene, chloranil, dinitroanthraquinone, trinitrofluorenone, picric acid, o-nitrobenzoic acid, p-nitrobenzoic acid and phthalic acid. Of these, fluorenone-based compounds, quinone-based compounds or benzene derivatives having an electron-withdrawing substituent such as Cl, CN or $NO_2$ or the like are particularly preferred.

The protective layer 7 is composed, for example, of a resin described below. Examples of resins that may be used include polycarbonate resins, polyester resins, methacrylic resins, acrylic resins, polyvinyl chloride resins, polyvinylidene chloride resins, polystyrene resins, polyvinyl acetate resins, styrene-butadiene copolymers, vinylidene chloride-acrylonitrile copolymers, vinyl chloride-vinyl acetate copolymers, vinyl chloride-vinyl acetate-maleic anhydride copolymers, silicone resins, silicone-alkyd resins, phenol-formaldehyde resins and styrene-alkyd resins, as well as polymer charge transport materials such as poly-N-vinylcarbazoles, polysilanes, and the polyester-based polymer charge transport materials disclosed in JP 08-176293 A and JP 08-208820 A. Of these, thermosetting resins such as phenolic resins, thermosetting acrylic resins, thermosetting silicone resins, epoxy resins, melamine resins, urethane resins, polyimide resins and polybenzimidazole resins are preferred. Of these, phenolic resins, melamine resins, benzoguanamine resins, siloxane resins and urethane resins are particularly favorable. A coating liquid containing one or more of these resins or precursors thereto can be applied, and the solvent can be then dried and a heat treatment conducted within a single step, thereby curing the coating and forming a cured film.

Examples of the phenolic resins include monomethylolphenol, dimethylolphenol and trimethylolphenol monomers, mixtures thereof, compounds obtained by oligomerizing these monomers, and mixtures of these monomers and oligomers. These types of phenolic resins are obtained by reacting a compound having a phenol structure, including resorcin or bisphenol, a substituted phenol containing a single hydroxyl group such as phenol, cresol, xylenol, para-alkylphenol or para-phenylphenol, a substituted phenol containing two hydroxyl groups such as catechol, resorcinol or hydroquinone, a bisphenol such as bisphenol A or bisphenol Z, or a biphenol, with formaldehyde, paraformaldehyde or the like, in the presence of an acid catalyst or alkali catalyst. Resins available commercially as phenolic resins may also be used as the phenolic resin. The phenolic resin is preferably a resol-type phenolic resin. In this description, comparatively large molecules in which the number of repeating structural units is not less than approximately 2 and not more than approximately 20 are referred to as oligomers, and compounds smaller than that are referred to as monomers.

Examples of the above acid catalyst include sulfuric acid, para-toluenesulfonic acid, and phosphoric acid. Further, examples of the alkali catalyst include hydroxides of the alkali metals or alkaline earth metals, such as NaOH, KOH $Ca(OH)_2$, and $Ba(OH)_2$, as well as amine-based catalysts.

Examples of the amine-based catalysts include ammonia, hexamethylenetetramine, trimethylamine, triethylamine and triethanolamine, although this is not an exhaustive list. In those cases where a basic catalyst is used, a large quantity of the carrier may tend to be trapped by the residual catalyst, causing a deterioration in the electrophotographic properties. Accordingly, this residual basic catalyst is preferably either neutralized with acid, or deactivated or removed by bringing the catalyst into contact with an adsorbent such as a silica gel, or an ion exchange resin or the like.

Examples of the melamine resins and benzoguanamine resins include methylol-type resins in which the methylol groups exist in an unmodified form, full ether-type resins in which all of the methylol groups have undergone alkyl etherification, full imino-type resins, and mixed type resins containing both methylol groups and imino groups. Of these, from the viewpoint of ensuring favorable stability of the coating liquid, an ether-type resin is preferred.

Examples of the urethane resins include polyfunctional isocyanates, isocyanurates, and blocked isocyanates in which these polyfunctional isocyanates and isocyanurates have been blocked with an alcohol or a ketone. Of these, from the viewpoint of ensuring favorable stability of the coating liquid, blocked isocyanates or isocyanurates are preferred, and these resins preferably undergo heated crosslinking with additives for the electrophotographic photoreceptor used in the image forming apparatus according to an exemplary embodiment of the present invention.

Examples of silicone resins that can be used include resins derived from compounds such as those represented by a general formula (X) shown below.

These resins may be used either alone, or in mixtures containing two or more different resins.

Conductive particles may be added to the protective layer 7 to lower the residual potential. Examples of these conductive particles include particles of metals, metal oxides or carbon black. Of these, metal and metal oxide particles are preferred. Examples of the metals include aluminum, zinc, copper, chromium, nickel, silver and stainless steel, as well as particles formed by vapor deposition of these metals onto the surface of plastic particles. Examples of the metal oxides include zinc oxide, titanium oxide, tin oxide, antimony oxide, indium oxide, bismuth oxide, tin-doped indium oxide, antimony or tantalum-doped tin oxide, and antimony-doped zirconium oxide. These materials may be used either alone, or in combinations of two or more different materials. If a combination of two or more different materials is used, then the materials may be simply mixed together, or may be used in the form of a solid solution or may be fused together. In order to maintain the transparency of the protective layer 7, the average particle size of these conductive particles is preferably not more than approximately 0.3 μm, and is even more preferably not more than approximately 0.1 μm.

Furthermore, in order to better control various physical properties such as the strength and the film resistance of the protective layer 7, a compound represented by the general formula (X) shown below may also be added to the curable resin composition used in forming the protective layer 7.

$$Si(R^{50})_{(4-c)}Q_c \qquad (X)$$

(In the above formula (X), $R^{50}$ represents a hydrogen atom, an alkyl group, or a substituted or unsubstituted aryl group, Q represents a hydrolyzable group, and c represents an integer from 1 to 4.)

Specific examples of the compounds represented by the above general formula (X) include the types of silane coupling agents listed below. Namely, examples of the silane coupling agents include tetrafunctional alkoxysilanes (c=4) such as tetramethoxysilane or tetraethoxysilane; trifunctional alkoxysilanes (c=3) such as methyltrimethoxysilane, methyltriethoxysilane, ethyltrimethoxysilane, methyltrimethoxyethoxysilane, vinyltrimethoxysilane, vinyltriethoxysilane, phenyltrimethoxysilane, γ-glycidoxypropylmethyldiethoxysilane, γ-glycidoxypropyltrimethoxysilane, γ-glycidoxypropyltriethoxysilane, γ-aminopropyltriethoxysilane, γ-aminopropyltrimethoxysilane, γ-aminopropylmethyldimethoxysilane, N-β-(aminoethyl)-γ-aminopropyltriethoxysilane, (tridecafluoro-1,1,2,2-tetrahydrooctyl)triethoxysilane, (3,3,3-trifluoropropyl)trimethoxysilane, 3-(heptafluoroisopropoxy)propyltriethoxysilane, 1H,1H,2H,2H-perfluoroalkyltriethoxysilane, 1H,1H,2H,2H-perfluorodecyltriethoxysilane or 1H,1H,2H,2H-perfluorooctyltriethoxysilane; bifunctional alkoxysilanes (c=2) such as dimethyldimethoxysilane, diphenyldimethoxysilane or methylphenyldimethoxysilane; and monofunctional alkoxysilanes (c=1) such as trimethylmethoxysilane. In order to improve the film strength, the trifunctional and tetrafunctional alkoxysilanes are preferred, whereas in order to improve the flexibility and film-forming properties, the monofunctional and bifunctional alkoxysilanes are preferred.

Further, silicon-based hard coating agents prepared using mainly these coupling agents can also be used. Commercially available hard coating agents include KP-85, X-40-9740 and X-40-2239 (all of which are manufactured by Shin-Etsu Silicones Co., Ltd.), and AY42-440, AY42-441 and AY49-208 (all of which are manufactured by Dow Corning Toray Co., Ltd.).

Furthermore, in order to increase the strength of the protective layer 7, a compound having two or more silicon atoms represented by a general formula (XI) shown below is preferably used in the curable resin composition used in forming the protective layer 7.

$$B—(Si(R^{51})_{(3-d)}Q_d)_2 \quad (XI)$$

(In the above formula (XI), B represents a bivalent organic group, $R^{51}$ represents a hydrogen atom, an alkyl group, or a substituted or unsubstituted aryl group, Q represents a hydrolyzable group, and d represents an integer from 1 to 3.)

Specific examples of preferred forms of the compound represented by the above general formula (XI) include the compounds (XI-1) to (XI-16) shown below. In the formulas, Me represents a methyl group, and Et represents an ethyl group.

TABLE I

| | |
|---|---|
| XI-1 | $(MeO)_3Si—(CH_2)_2—Si(OMe)_3$ |
| XI-2 | $(MeO)_2MeSi—(CH_2)_2—SiMe(OMe)_2$ |
| XI-3 | $(MeO)_2MeSi—(CH_2)_6—SiMe(OMe)_2$ |
| XI-4 | $(MeO)_3Si—(CH_2)_6—Si(OMe)_3$ |
| XI-5 | $(EtO)_3Si—(CH_2)_6—Si(OEt)_3$ |
| XI-6 | $(MeO)_2MeSi—(CH_2)_{10}—SiMe(OMe)_2$ |
| XI-7 | $(MeO)_3Si—(CH_2)_3—NH—(CH_2)_3—Si(OMe)_3$ |
| XI-8 | $(MeO)_3Si—(CH_2)_3—NH—(CH_2)_2—NH—(CH_2)_3—Si(OMe)_3$ |
| XI-9 | 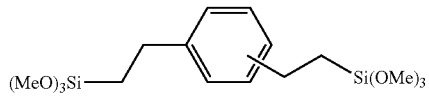 |
| XI-10 | 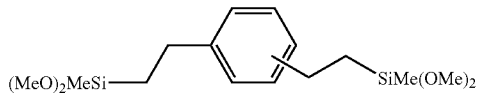 |
| XI-11 | 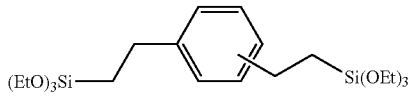 |
| XI-12 | 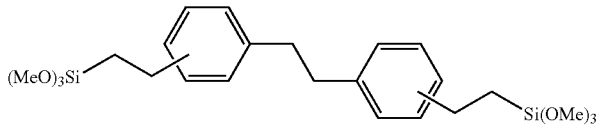 |
| XI-13 | 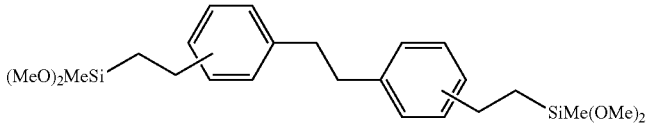 |
| XI-14 | 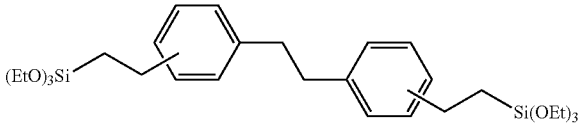 |
| XI-15 | $(MeO)_3SiC_3H_6—O—CH_2CH\{—O—C_3H_6Si(OMe)_3\}—CH_2\{—O—C_3H_6Si(OMe)_3\}$ |
| XI-16 | $(MeO)_3SiC_2H_4—SiMe_2—O—SiMe_2—O—SiMe_2—C_2H_4Si(OMe)_3$ |

In addition, in order to improve the control over the film properties, and prolong the lifespan of the liquid, a resin that is soluble in an alcohol-based or ketone-based solvent may also be added. Examples of this type of resin include polyvinyl acetal resins such as polyvinyl butyral resins, polyvinyl formal resins, and partially acetalized polyvinyl acetal resins in which a portion of the butyral groups have been modified with formal or acetoacetal groups or the like (examples of these polyvinyl acetal resins include S-LEC B and K manufactured by Sekisui Chemical Co., Ltd.), as well as polyamide resins, cellulose resins, and phenolic resins. In terms of improving the electrical properties, polyvinyl acetal resins are particularly desirable.

Further, a variety of other resins may also be added for purposes such as ensuring favorable discharge gas resistance, mechanical strength, abrasion resistance, particle dispersibility, viscosity control, torque reduction, control of the amount of abrasion, and extension of the pot life. In an exemplary embodiment of the present invention, the addition of a resin that is soluble in an alcohol is preferred. Examples of resins that are soluble in alcohol-based solvents include polyvinyl acetal resins such as polyvinyl butyral resins, polyvinyl formal resins and partially acetalized polyvinyl acetal resins in which a portion of the butyral groups have been modified with formal or acetoacetal groups or the like (examples of these polyvinyl acetal resins include S-LEC B and K manufactured by Sekisui Chemical Co., Ltd.), as well as polyamide resins and cellulose resins. In terms of improving the electrical properties, polyvinyl acetal resins are particularly desirable.

The weight average molecular weight of the above resin is preferably not less than approximately 2,000 and not more than approximately 100,000, and is even more preferably not less than approximately 5,000 and not more than approximately 50,000. If the weight average molecular weight is smaller than approximately 2,000, then the desired effect may tend to be unobtainable, whereas if the weight average molecular weight exceeds approximately 100,000, then the solubility may decrease, meaning the quantity of resin that can be added may be limited, and the resin also may tend to cause film-formation irregularities during coating. The quantity added of the resin is preferably not less than approximately 1% by mass and not more than approximately 40% by mass, is even more preferably not less than approximately 1% by mass and not more than approximately 30% by mass, and is most preferably not less than approximately 5% by mass and not more than approximately 20% by mass. If the quantity added is less than approximately 1% by mass, then the desired effect may tend to be unobtainable, whereas if the quantity exceeds approximately 40% by mass, then image blurring may tend to become problematic under conditions of high temperature and high humidity. The above resins may be either used alone, or in mixtures thereof.

Furthermore, in order to extend the pot life and improve the control of the film properties, a cyclic compound having a repeating structural unit represented by a general formula (XII) shown below, or a derivative of such a compound, is also preferably included in the protective layer composition.

In the above formula (XII), $A^1$ and $A^2$ each represent, independently, a monovalent organic group.

Examples of the cyclic compound having a repeating structural unit represented by the general formula (XII) include commercially available cyclic siloxanes. Specific examples include various cyclic siloxanes, including cyclic dimethylcyclosiloxanes such as hexamethylcyclotrisiloxane, octamethylcyclotetrasiloxane, decamethylcyclopentasiloxane and dodecamethylcyclohexasiloxane, cyclic methylphenylcyclosiloxanes such as 1,3,5-trimethyl-1,3,5-triphenylcyclotrisiloxane, 1,3,5,7-tetramethyl-1,3,5,7-tetraphenylcyclotetrasiloxane and 1,3,5,7,9-pentamethyl-1,3,5,7,9-pentaphenylcyclopentasiloxane, cyclic phenylcyclosiloxanes such as hexaphenylcyclotrisiloxane, fluorine atom-containing cyclosiloxanes such as 3-(3,3,3-trifluoropropyl)methylcyclotrisiloxane, mixtures of methylhydrosiloxanes, hydrosilyl group-containing cyclosiloxanes such as pentamethylcyclopentasiloxane and phenylhydrocyclosiloxane, and vinyl group-containing cyclosiloxanes such as pentavinylpentamethylcyclopentasiloxane. These cyclic siloxanes may be used either alone, or in mixtures containing two or more different compounds.

Moreover, in order to better control the resistance of the electrophotographic photoreceptor surface to the adhesion of foreign matter, as well as the surface lubricity, hardness or the like, various particles may also be added to the curable resin composition used in forming the protective layer 7.

One example of these particles is particles containing silicon atoms. Silicon atom-containing particles refer to particles containing silicon as a compositional element, and specific examples include colloidal silica and silicone particles. Colloidal silica materials that can be used as silicon atom-containing particles are selected from materials obtained by dispersing silica, having a volume average particle size of not less than approximately 1 nm and not more than approximately 100 nm, and preferably not less than approximately 10 nm and not more than approximately 30 nm, in an acidic or alkaline aqueous dispersion, or in an organic solvent such as an alcohols, ketones or esters, and materials that are generally available commercially can be used. The solid fraction content of colloidal silica within the curable resin composition is not specifically limited, but from the viewpoints of ensuring favorable film-forming properties, electrical properties, strength or the like, the colloidal silica solid fraction is preferably not less than approximately 0.1% by mass and not more than approximately 50% by mass, and even more preferably not less than approximately 0.1% by mass and not more than approximately 30% by mass, based on the total mass of the solid content within the curable resin composition.

The silicone particles used as silicon atom-containing particles may be spherical, may have a volume average particle size that is preferably not less than approximately 1 nm and not more than approximately 500 nm, and even more preferably not less than approximately 10 nm and not more than approximately 100 nm, may be selected from silicone resin particles, silicone rubber particles and silicone surface-treated silica particles, and may use particles that are generally available commercially.

The silicone particles may be chemically inactive, may be small-diameter particles that exhibit excellent dispersibility within resins, and further, the quantity of these particles required for obtaining a satisfactory effect may be small, meaning the surface properties of the electrophotographic photoreceptor can be improved without inhibiting the crosslinking reaction. In other words, the lubricity and water repellency of the electrophotographic photoreceptor surface can be improved by almost uniform incorporation of the silicone particles into the powerfully crosslinked structure, enabling favorable abrasion resistance and resistance to the adhesion of foreign matter to be maintained over a long period of time. The quantity of the silicone particles within the curable resin composition, relative to the total mass of the composition solid fraction, is preferably not less than approximately 0.1% by mass and not more than approximately 30% by mass, and is even more preferably not less than approximately 0.5% by mass and not more than approximately 10% by mass.

Other particles that may also be added include fluorine-based particles such as tetrafluoroethylene, trifluoroethylene, hexafluoropropylene, vinyl fluoride and vinylidene fluoride, particles composed of a resin obtained by copolymerizing a fluororesin and a monomer having a hydroxyl group, such as those disclosed in "Proceedings of the 8th Polymer Materials Forum, page 89", and semiconductive metal oxides such as $ZnO—Al_2O_3$, $SnO_2—Sb_2O_3$, $In_2O_3—SnO_2$, $ZnO—TiO_2$, $MgO—Al_2O_3$, $FeO—TiO_2$, $TiO_2$, $SnO_2$, $In_2O_3$, ZnO and MgO.

Furthermore, oils such as silicone oils may also be added in order to better control the resistance of the electrophotographic photoreceptor surface to the adhesion of foreign matter, as well as the surface lubricity, hardness or the like. Examples of these silicone oils include silicone oils such as dimethylpolysiloxaner diphenylpolysiloxane and phenylmethylpolysiloxane, and reactive silicone oils such as amino-modified polysiloxanes, epoxy-modified polysiloxanes, carboxyl-modified polysiloxanes, carbinol-modified polysiloxanes, methacryl-modified polysiloxanes, mercapto-modified polysiloxanes and phenol-modified polysiloxanes. These oils may be added in advance to the curable resin composition used in forming the protective layer 7, or may be applied following preparation of the photoreceptor, by impregnation under conditions of reduced pressure or applied pressure.

Further, additives such as plasticizers, surface modifiers, antioxidants and photodegradation inhibitors may also be added. Examples of plasticizers include biphenyl, biphenyl chloride, terphenyl, dibutyl phthalate, diethylene glycol phthalate, dioctyl phthalate, triphenyl phosphate, methylnaphthalene, benzophenone, chlorinated paraffin, polypropylene, polystyrene and various hydrofluorocarbons.

Moreover, antioxidants such as hindered phenols, hindered amines, and antioxidants containing partial thioether or phosphite structures may also be added, and these antioxidants may be effective in improving the stability of the potential and the image quality under fluctuating environmental conditions.

Specific examples of antioxidants include the compounds listed below. Namely, specific examples of hindered phenol antioxidants include Sumilizer BHT-R, Sumilizer MDP-S, Sumilizer BBM-S, Sumilizer WX-R, Sumilizer NW, Sumilizer BP-76, Sumilizer BP-101, Sumilizer Ga.-80, Sumilizer GM and Sumilizer GS (all of which are manufactured by Sumitomo Chemical Co., Ltd.), IRGANOX 1010, IRGANOX 1035, IRGANOX 1076, IRGANOX 1098, IRGANOX 1135, IRGANOX 1141, IRGANOX 1222, IRGANOX 1330, IRGANOX 1425WL, IRGANOX 1520L, IRGANOX 245, IRGANOX 259, IRGANOX 3114, IRGANOX 3790, IRGANOX 5057 and IRGANOX 565 (all of which are manufactured by Ciba Specialty Chemicals Inc.), and ADEKA STAB AO-20, ADEKA STAB AO-30, ADEKA STAB AO-40, ADEKA STAB AO-50, ADEKA STAB AO-60, ADEKA STAB AO-70, ADEKA STAB AO-80 and ADEKA STAB AO-330 (all of which are manufactured by Adeka Corporation). Specific examples of hindered amine antioxidants include SANOL LS2626, SANOL LS765, SANOL LS770 and SANOL LS744 (all of which are manufactured by Sankyo Life Tech, Co., Ltd.), TINUVIN 144 and TINUVIN 622LD (both manufactured by Ciba Specialty Chemicals Inc.), Mark La.57, Mark La.67, Mark La.62, Mark LA68 and Mark LA63 (all of which are manufactured by Adeka Corporation), and Sumilizer TPS (manufactured by Sumitomo Chemical Co., Ltd.). Specific examples of thioether-based antioxidants include Sumilizer TP-D (manufactured by Sumitomo Chemical Co., Ltd.). Specific examples of phosphite-based antioxidants include Mark 2112, Mark PEP•8, Mark PEP•24G, Mark PEP•36, Mark 329K and Mark HP•10 (all of which are manufactured by Adeka Corporation). Of these, the hindered phenol and hindered amine antioxidants are particularly preferred. Moreover, these antioxidants may be modified with substituents such as alkoxysilyl groups that are capable of undergoing crosslinking with materials that form crosslinked films.

Moreover, in order to remove the catalyst used during synthesis from the crosslinked resin such as the phenolic resin, melamine resin or benzoguanamine resin, the resin is preferably dissolved in a suitable solvent such as methanol, ethanol, toluene or ethyl acetate, washed with water, and then re-precipitated using a poor solvent. This treatment is preferably conducted using the materials exemplified below. Namely, examples of the materials include cation exchange resins such as AMBERLITE 15, AMBERLITE 200C and AMBERLYST 15E (all of which are manufactured by Rhom & Haas Company), DOWEX MWC-1-H, DOWEX 88 and DOWEX HCR-W2 (all of which are manufactured by Dow Chemical Company), LEWATIT SPC-108 and LEWATIT SPC-118 (both manufactured by Bayer AG), DIAION RCP-150H (manufactured by Mitsubishi Chemical Corporation), SUMIKAION KC-470, DUOLITE C26-C, DUOLITE C-433 and DUOLITE 464 (all of which are manufactured by Sumitomo Chemical Co., Ltd.), and NAFION H (manufactured by E.I. du Pont de Nemours and Company); anion exchange resins such as AMBERLITE IRA-400 and AMBERLITE IRA-45 (both manufactured by Rhom & Haas Company); inorganic solids containing protic acid group-containing groups bonded to the surface thereof, such as $Zr(O_3PCH_2CH_2SO_3H)_2$ and $Th(O_3PCH_2CH_2COOH)_2$; protic acid group-containing polyorganosiloxanes such as sulfonic acid group-containing polyorganosiloxanes; heteropolyacids such as cobalt tungstic acid and phosphorous molybdic acid; isopolyacids such as niobic acid, tantalic acid and molybdic acid; single-element metal oxides such as silica gel, alumina, chromia, zirconia, CaO and MgO; complex metal oxides such as silica-alumina, silica-magnesia, silica-zirconia and zeolite; clay minerals such as acid clay, activated clay, montmorillonite and kaolinite; metal sulfates such as $LiSO_4$ and $MgSO_4$; metal phosphates such as zirconia phosphate and lanthanum phosphate; metal nitrates such as $LiNO_3$ and $Mn(NO_3)_2$; inorganic solids having amino group-containing groups bonded to the surface thereof, such as the solid obtained by reacting aminopropyltriethoxysilane on silica gel; and amino group-containing polyorganosiloxanes such as amino-modified silicone resins.

Furthermore, in order to regulate film properties such as the hardness, adhesiveness and flexibility, epoxy group-containing compounds such as polyglycidyl methacrylates, glycidyl bisphenols and phenol epoxy resins, and biphenyltetracarboxylic acids such as terephthalic acid, maleic acid and pyromellitic acid, or the acid anhydrides thereof, may also be added. The quantity added of these compounds, per 1 part by mass of the additives used within the electrophotographic photoreceptor of an exemplary embodiment of the present invention, is preferably not less than approximately 0.05 parts by mass and not more than approximately 1 part by mass, and is even more preferably not less than approximately 0.1 parts by mass and not more than approximately 0.7 parts by mass.

Moreover, insulating resins such as polyvinyl butyral resins, polyarylate resins (such as polycondensates of bisphenol A and phthalic acid), polycarbonate resins, polyester resins, phenoxy resins, vinyl chloride-vinyl acetate copolymers, polyamide resins, acrylic resins, polyacrylamide resins, polyvinylpyridine resins, cellulose resins, urethane resins, epoxy resins, casein, polyvinyl alcohol resins, and polyvinylpyrrolidone resins may also be added in the desired proportion. Addition of this type of resin may improve adhesion to the charge transport layer 6 and suppress coating film defects caused by thermal shrinkage or cissing.

The protective layer 7 can be formed using a protective layer-forming coating liquid that contains each of the component materials described above. In other words, the protective layer 7 can be formed by applying the protective layer-forming coating liquid to the top of the charge transport layer 6, and then curing the liquid.

The protective layer-forming coating liquid may also include a solvent if necessary, and examples of the solvent include alcohols such as methanol, ethanol, propanol and butanol, ketones such as acetone and methyl ethyl ketone, and ethers such as tetrahydrofuran, diethyl ether and dioxane. Various other solvents can also be used, but in order to employ a dip coating method, which is the most commonly used method in the production of electrophotographic photoreceptors, an alcohol-based or ketone-based solvent, or a mixture thereof, is particularly preferred. Furthermore, solvents having a boiling point that is not less than approximately 50° C. and not more than approximately 150° C. are preferred, and appropriate mixtures of such solvents may also be used. The quantity of solvent used can be set as required, but if the quantity of solvent is too small, then the coating liquid may be prone to precipitation, and consequently the quantity of solvent per 1 part by mass of the combined solid fraction within the protective layer-forming coating liquid is preferably not less than approximately 0.5 parts by mass and not more than approximately 30 parts by mass, and is even more preferably not less than approximately 1 part by mass and not more than approximately 20 parts by mass.

Moreover, when crosslinking is conducted, a curing catalyst may also be used within the protective layer-forming coating liquid. Preferred examples of the curing catalyst include photoacid generators, including bissulfonyldiazomethanes such as bis(isopropylsulfonyl)diazomethane, bissulfonylmethanes such as methylsulfonyl p-toluenesulfonylmethane, sulfonylcarbonyldiazomethanes such as cyclohexylsulfonylcyclohexylcarbonyldiazomethane, sulfonylcarbonylalkanes such as 2-methyl-2-(4-methylphenylsulfonyl)propiophenone, nitrobenzyl sulfonates such as 2-nitrobenzyl p-toluenesulfonate, alkyl or aryl sulfonates such as pyrogallol trismethanesulfonate, benzoin sulfonates such as benzoin tosylate, N-sulfonyloxyimides such as N-(trifluoromethylsulfonyloxy)phthalimide, pyridones such as (4-fluorobenzenesulfonyloxy)-3,4,6-trimethyl-2-pyridone, sulfonates such as 2,2,2-trifluoro-1-trifluoromethyl-1-(3-vinylphenyl)-ethyl-4-chlorobenzene sulfonate, and onium salts such as triphenylsulfonium methanesulfonate and diphenyliodonium trifluoromethanesulfonate; as well as compounds obtained by neutralizing a protic acid or a Lewis acid with a Lewis base, mixtures of a Lewis acid and a trialkyl phosphate, sulfonate esters, phosphate esters, onium compounds, and carboxylic anhydride compounds.

Examples of the compounds obtained by neutralizing a protic acid or a Lewis acid with a Lewis base include compounds obtained by neutralizing halogenocarboxylic acids, sulfonic acids, sulfate monoesters, phosphate mono- or di-esters, polyphosphate esters, or borate mono- or di-esters with ammonia, any of various amines such as monoethylamine, triethylamine, pyridine, piperidine, aniline, morpholine, cyclohexylamine, n-butylamine, monoethanolamine, diethanolamine or triethanolamine, or a trialkylphosphine, triarylphosphine, trialkylphosphite or triarylphosphite, as well as the commercially available products NACURE 2500X, 4167, X-47-110, 3525 and 5225 (product names, manufactured by King Industries, Inc.), which are marketed as acid-base blocked catalysts. Furthermore, additional examples of compounds obtained by neutralizing a Lewis acid with a Lewis base include compounds obtained by neutralizing a Lewis acid such as $BF_3$, $FeCl_3$, $SnCl_4$, $AlCl_3$ or $ZnCl_2$ with one of the Lewis bases described above.

Examples of the onium compounds include triphenylsulfonium methanesulfonate and diphenyliodonium trifluoromethanesulfonate.

Examples of the carboxylic anhydride compounds include acetic anhydride, propionic anhydride, butyric anhydride, isobutyric anhydride, lauric anhydride, oleic anhydride, stearic anhydride, n-caproic anhydride, n-caprylic anhydride, n-capric anhydride, palmitic anhydride, myristic anhydride, trichloroacetic anhydride, dichloroacetic anhydride, monochloroacetic anhydride, trifluoroacetic anhydride, and heptafluorobutyric anhydride.

Specific examples of the Lewis acids include metal halides such as boron trifluoride, aluminum trichloride, titanium trichloride, titanium tetrachloride, ferrous chloride, ferric chloride, zinc chloride, zinc bromide, stannous chloride, stannic chloride, stannous bromide and stannic bromide, organometallic compounds such as trialkylborons, trialkylaluminums, dialkylaluminum halides, monoalkylaluminum halides and tetraalkyltins, metal chelate compounds such as diisopropoxyethylacetoacetate aluminum, tris(ethylacetoacetate)aluminum, tris(acetylacetonato)aluminum, diisopropoxy bis(ethylacetoacetate)titanium, diisopropoxy bis(acetylacetonato)titanium, tetrakis(n-propylacetoacetate) zirconium, tetrakis(acetylacetonato)zirconium, tetrakis (ethylacetoacetate)zirconium, dibutyl bis(acetylacetonato) tin, tris(acetylacetonato)iron, tris(acetylacetonato)rhodium, bis(acetylacetonato)zinc and tris(acetylacetonato)cobalt, and metallic soaps such as dibutyltin dilaurate, dioctyltin ester maleate, magnesium naphthenate, calcium naphthenate, manganese naphthenate, iron naphthenate, cobalt naphthenate, copper naphthenate, zinc naphthenate, zirconium naphthenate, lead naphthenate, calcium octylate, manganese octylate, iron octylate, cobalt octylate, zinc octylate, zirconium octylate, tin octylate, lead octylate, zinc laurate, magnesium stearate, aluminum stearate, calcium stearate, cobalt stearate, zinc stearate and lead stearate. These compounds may be used either alone, or in combinations of two or more different compounds.

There are no particular restrictions on the quantity used of these catalysts, although the quantity is preferably not less than approximately 0.1 parts by mass and not more than approximately 20 parts by mass, and is even more preferably not less than approximately 0.3 parts by mass and not more than approximately 10 parts by mass, per 100 parts by mass of the total solid fraction of the protective layer-forming coating liquid.

The coating method used when applying the protective layer-forming coating liquid to the charge transport layer 6 may employ a typical method such as blade coating, Meyer bar coating, spray coating, dip coating, bead coating, air knife coating, or curtain coating. Following application, the coating film can be dried to form the protective layer 7.

At the time of coating, if the required film thickness is not obtainable with a single application, the necessary film thickness can be obtained by repeating the application multiple times. If repeated applications are performed, a heat treatment may be performed after each application, or may be performed after multiple applications.

If the protective layer 7 is formed using a resin having a crosslinking structure, the curing temperature during crosslinking is preferably not less than approximately 100° C. and not more than approximately 170° C., and is even more preferably not less than approximately 100° C. and not more than approximately 160° C. Moreover, the curing time is preferably not shorter than approximately 30 minutes and not longer than approximately 2 hours, and is even more preferably not shorter than approximately 30 minutes and not longer than approximately 1 hour. The heating temperature may be altered in multiple steps.

In terms of the atmosphere for conducting the crosslinking reaction, deterioration in the electrical properties may be prevented by performing the reaction under an atmosphere of a so-called oxidation inert gas such as nitrogen, helium or argon. If the crosslinking reaction is conducted under an inert gas atmosphere, the curing temperature can be set to a higher temperature than that usable in an open-air atmosphere, and in such cases, the curing temperature is preferably not less than approximately 100° C. and not more than approximately 180° C., and is even more preferably not less than approximately 110° C. and not more than approximately 160° C. Further, the curing time is preferably not shorter than approximately 30 minutes and not longer than approximately 2 hours, and is even more preferably not shorter than approximately 30 minutes and not longer than approximately 1 hour.

The film thickness of the protective layer 7 is preferably not less than approximately 0.5 μm and not more than 15 μm, even more preferably not less than approximately 1 μm and not more than 10 μm, and is most preferably not less than approximately 1 μm and not more than 5 μm.

The oxygen permeability coefficient of the protective layer 7 at 25° C. is preferably not more than approximately $4\times10^{12}$ fm/s·Pa, even more preferably not more than approximately $3.5\times10^{12}$ fm/s·Pa, and is most preferably not more than approximately $3\times10^{12}$ fm/s·Pa.

Here, the oxygen permeability coefficient is an indicator that represents the ease with which oxygen gas permeates into a layer, or from a different point of view, may be considered as a property that is representative of the physical void ratio within the layer. Although the absolute value of the permeability coefficient may differ depending on the type of gas, the magnitude correlation between layers used as test specimens may be almost never reversed. Accordingly, the oxygen permeability coefficient may be interpreted as an indicator representing the ease of general gas permeation.

In other words, if the oxygen permeability coefficient of the protective layer 7 at 25° C. satisfies the condition described above, gas may be very unlikely to permeate the protective layer 7. Accordingly, permeation of electrical discharge products generated during the image formation process can be suppressed, degradation of compounds contained within the protective layer 7 can be inhibited, and the electrical properties may be maintained at a high level, which may be effective in improving the image quality and prolonging the service lifespan.

If a single-layer photosensitive layer is used in the electrophotographic photoreceptor 1, the single-layer photosensitive layer can be formed using a charge generation material and a binder resin. The charge generation material may be a similar material to that used within the charge generation layer in a function-separated type photosensitive layer, whereas the binder resin may use a similar binder resin to that used within the charge generation layer and the charge transport layer in a function-separated photosensitive layer. The quantity of the charge generation material within the single-layer photosensitive layer, relative to the total mass of the solid fraction within the single-layer photosensitive layer, is preferably not less than approximately 10% by mass and more than approximately 85% by mass, and is even more preferably not less than approximately 20% by mass and not more than approximately 50% by mass. In the single-layer photosensitive layer, a charge transport material or a polymer charge transport material may be added in order to improve the photoelectric properties. The quantity added of this charge transport material or polymer charge transport material is preferably not less than approximately 5% by mass and not more than approximately 50% by mass, relative to the total mass of the solid fraction within the single-layer photosensitive layer. Furthermore, the solvent used for coating, and the coating method may be similar to those described above for each of the other layers. The thickness of the single-layer photosensitive layer is preferably not less than approximately 5 μm and not more than approximately 50 μm, and is even more preferably not less than approximately 10 μm and not more than approximately 40 μm.

Next is a description of the developing device 25. The developing device 25 can be used for developing an electrostatic latent image on the electrophotographic photoreceptor 1 to form a toner image.

A toner used in the developing device 25 is described below.

This toner preferably has an average shape factor SF1 ($SF1=(ML^2/A)\times(n/4)\times100$ (wherein ML represents the maximum length of the particle, and A represents the projected area of the particle)) that is not less than approximately 100 and not more than approximately 150, and is even more preferably not less than approximately 100 and not more than approximately 140. The average shape factor (SF1) can be determined by capturing an image of toner particles on a slide glass with a video camera through an optical microscope, transferring the image into an image analyzer (LUZEX III, manufactured by NIRECO Corporation), calculating the maximum length (ML) and the projected area (A) of a toner particle, and then inserting these values into the above equation to calculate the shape factor. The average shape factor is the average value of shape factors calculated using the above equation for a random selection of approximately 100 toner particles.

The toner has a volume average particle size that is preferably not less than approximately 2 μm and not more than approximately 12 μm, more preferably not less than approximately 3 μm and not more than approximately 12 μm, and most preferably not less than approximately 3 μm and not more than approximately 9 μm. By using a toner that satisfies the above ranges for the average shape factor and the volume average particle size, superior developing properties and transfer properties, and higher quality images can be obtained.

The toner is not particularly limited by the production method, provided the average shape factor and the average particle size satisfy the ranges described above. Examples of methods of producing the toner include a kneading pulverization method in which a mixture of a binder resin, a colorant, a release agent and, if required, a charge control agent and the like is kneaded, pulverized and classified; a method in which the particles obtained from a kneading pulverization method are altered in shape, either by mechanical impact or thermal energy; an emulsion polymerization coagulation method in which a polymerizable monomer of a binder resin is subjected to emulsion-polymerization, the thus formed dispersion is mixed with another dispersion containing a colorant, a release agent and, if required, a charge control agent or the like, and the mixture is then coagulated and fused under heating to generate the toner particles; a suspension polymerization method in which a polymerizable monomer used to obtain a binder resin and a solution containing a colorant, a release agent and, if required, a charge control agent or the like are suspended in an aqueous medium and subsequently polymerized; and a dissolution suspension method in which a binder resin, and a solution containing a colorant, a release agent and, if required, a charge control agent or the like are suspended in an aqueous solvent medium and granulated.

Moreover, a conventional method in which the toner particles obtained from one of the above methods are used as a core, and coagulated particles are then adhered to the core and fused under heating to generate a core-shell structure may also be used. In terms of the ability to control the particle shape and the particle size distribution, the suspension polymerization method, the emulsion polymerization coagulation method and the dissolution suspension method, in which production is conducted in aqueous solvent media, are preferred, and the emulsion polymerization coagulation method is particularly desirable.

The toner matrix particles can contain a binder resin, a colorant and a release agent, and if necessary, may also contain a silica and a charge control agent.

Examples of the binder resin used for the toner matrix particles include homopolymers and copolymers of styrenes such as styrene and chlorostyrene, monoolefins such as ethylene, propylene, butylene, and isoprene, vinyl esters such as vinyl acetate, vinyl propionate, vinyl benzoate and vinyl butyrate, α-methylene aliphatic monocarboxylates such as methyl acrylate, ethyl acrylate, butyl acrylate, dodecyl acrylate, octyl acrylate, phenyl acrylate, methyl methacrylate, ethyl methacrylate, butyl methacrylate and dodecyl methacrylate, vinyl ethers such as vinyl methyl ether, vinyl ethyl ether and vinyl butyl ether, and vinyl ketones such as vinyl methyl ketone, vinyl hexyl ketone and vinyl isopropenyl ketone, as well as polyester resins formed by copolymerization of a dicarboxylic acid and a diol.

Particularly representative examples of the binder resin include polystyrene, styrene-alkyl acrylate copolymers, styrene-alkyl methacrylate copolymers, styrene-acrylonitrile copolymers, styrene-butadiene copolymers, styrene-maleic anhydride copolymers, polyethylene, polypropylene, and polyester resins. Further examples include polyurethane, epoxy resins, silicone resins, polyamides, modified rosin, and paraffin wax.

Typical examples of the colorant include magnetic powders such as magnetite and ferrite, carbon black, aniline blue, calco oil blue, chrome yellow, ultramarine blue, DuPont oil red, quinoline yellow, methylene blue chloride, phthalocyanine blue, malachite green oxalate, lamp black, rose bengal, C.I. Pigment Red 48:1, C.I. Pigment Red 122, C.I. Pigment Red 57:1, C.I. Pigment Yellow 97, C.I. Pigment Yellow 17, C.I. Pigment Blue 15:1 and C.I. Pigment Blue 15:3.

Typical examples of the release agent include low-molecular weight polyethylene, low-molecular weight polypropylene, Fischer-Tropsch wax, montan wax, carnauba wax, rice wax, and candelilla wax.

Conventional materials may be used as the charge control agent, and typical examples include azo-based metal complex compounds, metal complex compounds of salicylic acid, and resin type charge control agents containing polar groups. When the toner is produced using a wet production method, the use of a material that is only sparingly soluble in water is preferred in terms of controlling the ionic strength and reducing contamination of the wastewater, Moreover, the toner may be either a magnetic toner that incorporates a magnetic material, or a non-magnetic toner containing no magnetic material.

The toner used in the developing device 25 can be produced by mixing the above toner matrix particles with the aforementioned external additives, using a Henschel mixer or a V-type blender or the like. Further, in those cases where the toner matrix particles are produced using a wet method, addition of the external additives may also be performed using a wet method.

Lubricating particles may also be added to the toner used in the developing device 25. Examples of these lubricating particles include solid lubricants such as graphite, molybdenum disulphide, talcum, fatty acids and metal salts of fatty acids, low-molecular weight polyolefins such as polypropylene, polyethylene and polybutene, silicones that can be softened by heating, fatty acid amides such as oleamide, erucamide, ricinoleamide and stearamide, plant-based waxes such as carnauba wax, rice wax, candelilla wax, Japan wax and jojoba oil, animal-based waxes such as beeswax, mineral and petroleum-based waxes such as montan wax, ozokerite, creresin, paraffin wax, microcrystalline wax and Fischer-Tropsch wax, as well as modified products of the above materials. One type of these lubricating particles may be used alone, or combinations of two or more different types of particles may be used. The volume average particle size of the lubricating particles is preferably not less than approximately 0.1 μm and not more than approximately 10 μm, and this particle size may be equalized by crushing the materials of the chemical structures listed above. The quantity of lubricating particles added to the toner is preferably not less than approximately 0.05% by mass and not more than approximately 2.0% by mass, and is even more preferably not less than approximately 0.1% by mass and not more than approximately 1.5% by mass.

In order to remove adhered substances, degraded residues or the like from the surface of the electrophotographic photoreceptor, the toner used in the developing device 25 may also include inorganic particles, organic particles, complex particles having the inorganic particles adhered to organic particles, or the like.

Examples of inorganic particles that may be used include various inorganic oxides, nitrides and borides, such as silica, alumina, titania, zirconia, barium titanate, aluminum titanate, strontium titanate, magnesium titanate, zinc oxide, chromium oxide, cerium oxide, antimony oxide, tungsten oxide, tin oxide, tellurium oxide, manganese oxide, boron oxide, silicon carbide, boron carbide, titanium carbide, silicon nitride, titanium nitride, and boron nitride.

Moreover, the above inorganic particles may be treated with a titanium coupling agent such as tetrabutyl titanate, tetraoctyl titanate, isopropyltriisostearoyl titanate, isopropyltridecylbenzenesulfonyl titanate or bis(dioctyl pyrophosphate)oxyacetate titanate, or with a silane coupling agent such as γ-(2-aminoethyl)aminopropyltrimethoxysilane, γ-(2-aminoethyl)aminopropylmethyldimethoxysilane, γ-methacryloxypropyltrimethoxysilane, N-β-(N-vinylbenzylaminoethyl)γ-aminopropyltrimethoxysilane hydrochloride, hexamethyldisilazane, methyltrimethoxysilane, butyltrimethoxysilane, isobutyltrimethoxysilane, hexyltrimethoxysilane, octyltrimethoxysilane, decyltrimethoxysilane, dodecyltrimethoxysilane, phenyltrimethoxysilane, o-methylphenyltrimethoxysilane and p-methylphenyltrimethoxysilane. Moreover, inorganic particles that have undergone a hydrophobic treatment with a silicone oil or a metal salt of a higher fatty acid such as aluminum stearate, zinc stearate or calcium stearate may also be used.

Examples of the organic particles include styrene resin particles, styrene acrylic resin particles, polyester resin particles, and urethane resin particles.

In terms of the particle size, the volume average particle size is preferably not less than approximately 5 nm and not more than approximately 1,000 nm, more preferably not less than approximately 5 nm and not more than approximately 800 nm, and most preferably not less than approximately 5 nm and not more than approximately 700 nm. If the volume average particle size is less than the lower limit of the above range, then the abrasive ability may tend to be insufficient, whereas if the volume average particle size exceeds the upper limit, the surface of the electrophotographic photoreceptor may be prone to scratching. Moreover, the combined total of the quantities of the above particles and the lubricating particles is preferably not less than approximately 0.6% by mass.

In terms of other inorganic oxides that may be added to the toner, inorganic oxide particles having a small diameter with a primary particle size of not more than approximately 40 nm may be added in order to control the powder flowability and the charging properties and the like, and inorganic oxide particles having a larger diameter may be added in order to reduce the adhesive strength and control the charging properties. These inorganic oxide particles may use conventional oxides, and in order to more precisely control the charging properties, silica and titanium oxide are preferably used in combination. Further, by surface treating the inorganic particles having a small diameter, the dispersibility can be increased, and the effect of the particles in improving the powder flowability can be enhanced. Furthermore, carbonates such as calcium carbonate and magnesium carbonate, and inorganic minerals such as hydrotalcite are also preferably added in order to remove electrical discharge products.

The electrophotographic color toner can be used in a mixture with a carrier. Examples of materials that may be used as the carrier include iron powder, glass beads, ferrite powder and nickel powder, as well as materials prepared by coating the surface of these materials with a resin coating. The blend ratio between the toner and the carrier may be set as required.

The cleaning device 27 may include a (roller-shaped) fibrous member 27*a* and a cleaning blade (a blade member) 27*b*.

The cleaning device 27 can be provided with a fibrous member 27*a* and a cleaning blade 27*b*, although the cleaning device may be provided with either one of these. The fibrous member 27*a* may be formed in the shape of a roller, or may be formed in the shape of a toothbrush. Moreover, the fibrous member 27*a* may be fixed to the main body of the cleaning device, and may be supported in a rotatable manner, and supported so as to be capable of oscillation in the axial direction of the photoreceptor. Examples of the fibrous member 27*a* include cloth formed from polyester, nylon, acrylic fiber or an ultra fine fiber such as TRACY (manufactured by Toray Industries, Inc.) or the like, and brush-shaped members prepared by flocking a resin fiber of a nylon, acrylic, polyolefin or polyester or the like into a substrate form or carpet form. Moreover, the fibrous member 27*a* may be imparted with conductivity by blending a conductive powder or an ion-conductive agent into the members described above, or the fibrous member 27*a* may include a conductive layer formed on the inside or outside of each individual fiber. If conductivity is imparted to the fibrous member, then the resistance value for a single fiber strand is preferably not less than approximately $10^2\Omega$ and not more than approximately $10^9\Omega$. The thickness of the fiber within the fibrous member 27*a* is preferably not more than approximately 30 d (denier), and is even more preferably not more than approximately 20 d. The fiber density is preferably not less than approximately 20,000/inch$^2$, and is even more preferably approximately 30,000/inch$^2$ or greater.

The cleaning device 27 can remove adhered substances (such as an electrical discharge products) from the surface of the photoreceptor using a cleaning blade or a cleaning brush. In order to enable this function to be achieved over a long period of time, and to stabilize the function of the cleaning member, the cleaning member is preferably supplied with a lubricating material (a lubricating component) such as a metallic soap, higher alcohol, wax or silicone oil.

For example, if a roller-shaped member is used as the fibrous member 27*a*, the member is preferably brought into contact with a lubricating material such as a metallic soap or a wax, thereby supplying the lubricating component to the surface of the electrophotographic photoreceptor. A typical rubber blade may be used as the cleaning blade 27*b*. In those cases where such a rubber blade is used as the cleaning blade 27*b*, supplying a lubricating component to the surface of the electrophotographic photoreceptor may be particularly effective in suppressing chipping or abrasion of the blade.

The process cartridge 20 described above can be detachable from the main casing of the image forming apparatus, and the combination of the process cartridge 20 and the image forming apparatus main casing can constitute the image forming apparatus.

The exposure device 30 may be any type of device capable of exposing the charged electrophotographic photoreceptor 1 to form an electrostatic latent image. Moreover, the light source for the exposure device 30 is preferably a multi-beam surface-emitting laser.

The transfer device 40 may be any type of device capable of transferring the toner image on the electrophotographic photoreceptor 1 to the transfer target medium (such as the intermediate transfer member 50), and typically used roller-shape devices may be used.

The intermediate transfer member 50 may use a belt-shaped member (an intermediate transfer belt) formed from a polyimide, polyamideimide, polycarbonate, polyarylate, polyester or rubber or the like that has been imparted with semiconductivity. Furthermore, besides a belt-shaped member, the intermediate transfer member 50 may also use a drum-shaped member. Direct transfer-type image forming apparatuses which have no intermediate transfer member can also be used.

There are no particular restrictions on the transfer target medium, provided it is a medium onto which the toner image formed on the electrophotographic photoreceptor 1 is able to be transferred. For example, if the image is transferred directly from the electrophotographic photoreceptor 1 to a sheet of paper or the like, then the paper or the like can function as the transfer target medium. Further, in those cases where the intermediate transfer member 50 is used, the intermediate transfer member can function as the transfer target medium.

Figure 3:
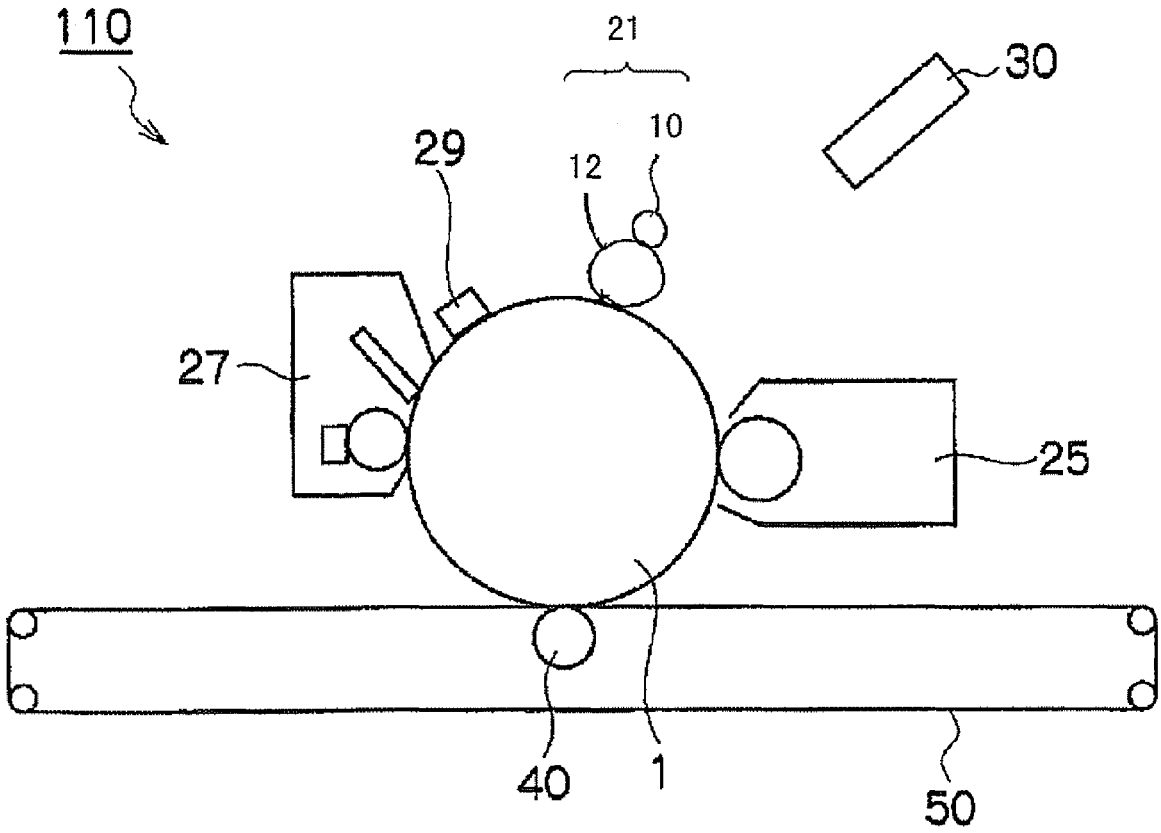
FIG. 3 is a schematic illustration showing another example of an image forming apparatus according to an exemplary embodiment of the present invention.

FIG. 3 is a schematic illustration showing another example of an image forming apparatus according to an exemplary embodiment of the present invention. In the image forming apparatus 110 shown in FIG. 3, the electrophotographic photoreceptor 1 can be fixed to the main casing of the image forming apparatus, and the charging device 21, the developing device 25, and the cleaning device 27 can be each provided in cartridge form, and can be installed independently as a charging cartridge, a developing cartridge, and a cleaning cartridge respectively.

In the image forming apparatus 110, the electrophotographic photoreceptor 1 and the other devices can be separated. The charging device 21, the developing device 25, and the cleaning device 27 can be detachable, and may be pulled out from, and pushed into, the apparatus, rather than being fixed to the main casing of the image forming apparatus by screws, caulking, bonding or welding.

In those cases where an electrophotographic photoreceptor having excellent abrasion resistance is used, cartridging may be unnecessary in some cases. Accordingly, by adopting a construction in which the charging device 21, the developing device 25, and the cleaning device 27 are detachable, and may be pulled out from, and pushed into, the apparatus, rather than being fixed to the main casing by screws, caulking, bonding or welding, the cost of the members per print can be reduced. Further, two or more devices may be integrated to form a single detachable cartridge, and this enables the cost of the members per print to be reduced even further.

With the exception of the fact that the charging device 21, the developing device 25, and the cleaning device 27 are provided as independent cartridges, the image forming apparatus 110 has the same structure as that of the image forming apparatus 100.

Figure 4:
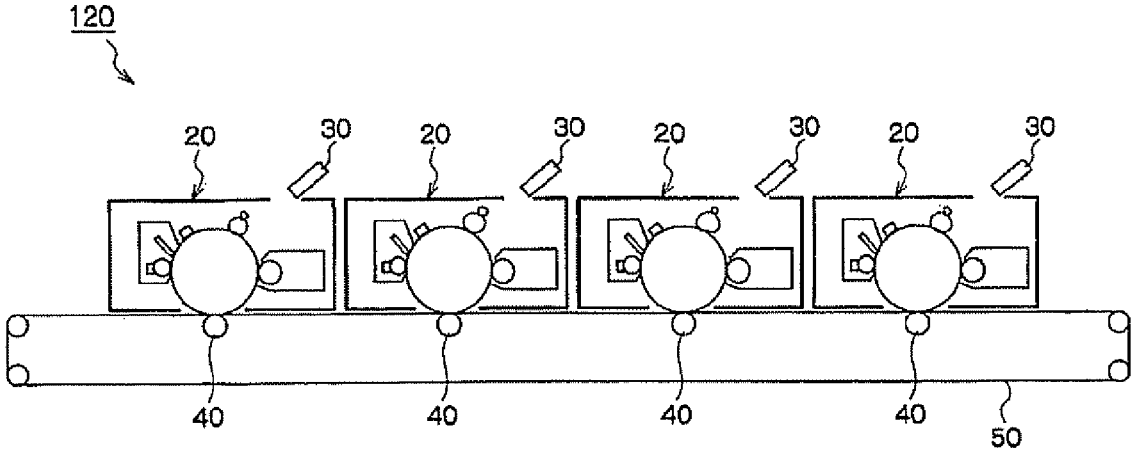
FIG. 4 is a schematic illustration showing yet another example of an image forming apparatus according to an exemplary embodiment of the present invention.

FIG. 4 is a schematic illustration showing yet another example of an image forming apparatus according to an exemplary embodiment of the present invention. The image forming apparatus 120 is a tandem-type full color image forming apparatus with four installed process cartridges 20. The image forming apparatus 120 can employ a structure in which the four process cartridges 20 are arranged in substantially parallel on the intermediate transfer member 50, with one electrophotographic photoreceptor used for each color. With the exception of employing a tandem-type construction, the image forming apparatus 120 has the same structure as that of the image forming apparatus 100.

In the tandem-type image forming apparatus 120, because the amount of abrasion of each electrophotographic photoreceptor may differ depending on the relative usage of each color, the electrical properties of each electrophotographic photoreceptor may tend to be different. As a result of this difference, the toner development properties may gradually change from their initial state, causing changes in the hue of the printed image, and making it difficult achieve a stable image. Moreover, in order to miniaturize the image forming apparatus, electrophotographic photoreceptors having a small diameter tend to be used, and when electrophotographic photoreceptors having diameters of not more than approximately 30 mm are used, the above image stability problem may be particularly pronounced. If an electrophotographic photoreceptor of an exemplary embodiment of the present invention is employed for the electrophotographic photoreceptors, then even if the diameter is approximately 30 mm or less, abrasion of the surface of the photoreceptors may still be suppressed. Accordingly, an electrophotographic photoreceptor according to an exemplary embodiment of the present invention may be particularly effective for use within a tandem-type image forming apparatus.

Figure 5:
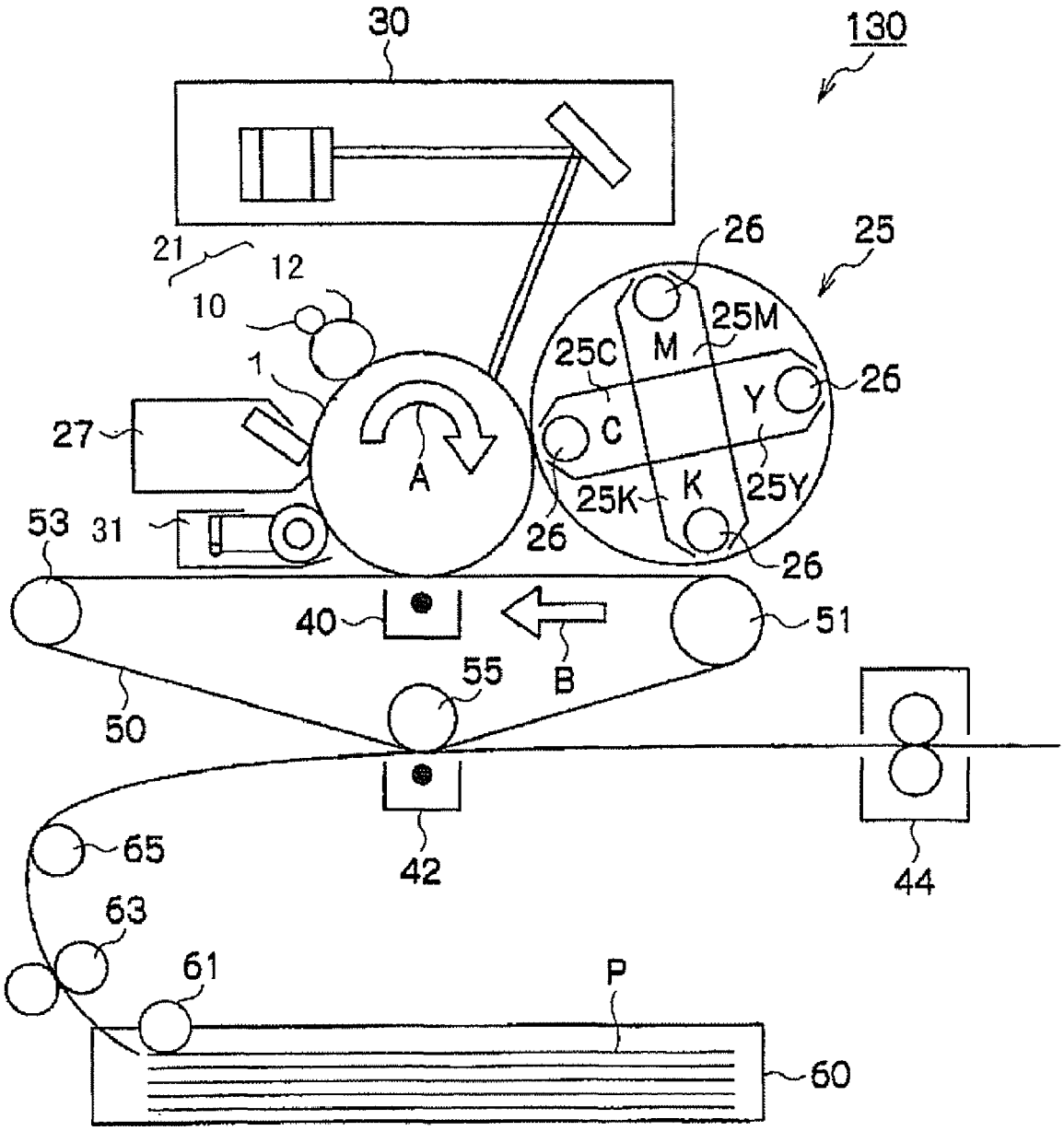
FIG. 5 is a schematic illustration showing yet another example of an image forming apparatus according to an exemplary embodiment of the present invention.

FIG. 5 is a schematic illustration showing yet another example of an image forming apparatus according to an exemplary embodiment of the present invention. The image forming apparatus 130 shown in FIG. 5 is a so-called four cycle-type image forming apparatus in which toner images of multiple colors can be formed with one electrophotographic photoreceptor. The image forming apparatus 130 may include a photoreceptor drum 1, which is rotated by a drive unit (not shown in the figure) at a predetermined rotational speed in the direction of an arrow A shown in the figure. A charging device 21 that charges the outer peripheral surface of the photoreceptor drum 1 can be provided above the photoreceptor drum 1.

An exposure device 30 equipped with a surface-emitting laser array as the exposure light source can be disposed above the charging device 21. The exposure device 30 can modulate the multiple laser beams emitted from the light source in accordance with the image to be formed, and can deflect them in the main scanning direction, thereby scanning the outer peripheral surface of the photoreceptor drum 1 in a direction almost parallel to the axis of the photoreceptor drum 1. As a result, an electrostatic latent image can be formed on the outer peripheral surface of the charged photoreceptor drum 1.

The developing device 25 can be positioned to the side of the photoreceptor drum 1. The developing device 25 may include a roller-shaped housing that is arranged so as to be rotatable. Four storage units can be formed inside this housing, and developing units 25Y, 25M, 25C and 25K can be provided inside these storage units. The developing units 25Y, 25M, 25C and 25K each may contain a developing roller 26, and can be used for storing colored toners of yellow (Y), magenta (M), cyan (C), and black (K) respectively.

The formation of a full color image using the image forming apparatus 130 may undergo by image forming of the photoreceptor drum 1 four times. In other words, during the period while the photoreceptor drum 1 forms the image four times, an operation can be repeated in which the charging device 21 charges the outer peripheral surface of the photoreceptor drum 1, and the exposure device 30 can scan the outer peripheral surface of the photoreceptor drum 1 with laser beams that have been modulated in accordance with the image data for one of the colors Y, N, C or K used to represent the color image being formed. This operation can be repeated for each image forming of the photoreceptor drum 1, while the image data used for modulating the laser beams is switched between the four colors. Furthermore, for each image forming of the photoreceptor drum 1, the developing device 25 can activate one of the developing units 25Y, 25M, 25C and 25K that is facing the outer peripheral surface of the photoreceptor drum 1, with the developing roller 26 of that particular developing unit facing the outer peripheral surface, thereby developing the electrostatic latent image formed on the outer peripheral surface of the photoreceptor drum 1 into the specified color, and forming a toner image of that specified color on the outer peripheral surface of the photoreceptor drum 1. This operation can be repeated while rotating the housing so as to switch the developing unit used for developing the electrostatic latent image. As a result, Y, M, C and K toner images can be formed sequentially on the outer peripheral surface of the photoreceptor drum 1 with each image forming of the photoreceptor drum 1. Furthermore, an endless intermediate transfer belt 50 may be positioned beneath the photoreceptor drum 1. The intermediate transfer belt 50 may be wrapped around rollers 51, 53 and 55, and may be arranged so that the outer peripheral surface of the belt is in contact with the outer peripheral surface of the photoreceptor drum 1. The rollers 51, 53 and 55 can be rotated by transmission of a driving force from a motor (which is not shown in the figure), thereby rotating the intermediate transfer belt 50 in the direction of the arrow B shown in FIG. 5.

A transfer device (a transfer unit) 40 may be positioned on the opposite side of the intermediate transfer belt 50 to the photoreceptor drum 1, and the Y, M, C and K toner image formed sequentially on the outer peripheral surface of the photoreceptor drum 1 can be transferred to the image formation surface of the intermediate transfer belt 50 by the transfer device 40. Finally, Y, M, C and K image has been formed on the intermediate transfer belt 50.

Further, a lubricant supply device 31 and a cleaning device 27 may be disposed on the outer peripheral surface of the photoreceptor drum 1, in positions on the opposite side of the photoreceptor drum 1 to the developing device 25. Once the toner image formed on the outer peripheral surface of the photoreceptor drum 1 has been transferred onto the intermediate transfer belt 50, the lubricant supply device 31 can supply a lubricant to the outer peripheral surface of the photoreceptor drum 1, and the area of the outer peripheral surface on which the transferred toner image was held can be cleaned by the cleaning device 27.

A paper holder 60 may be positioned beneath the intermediate transfer belt 50, and multiple sheets of a paper P that act as a recording material (the transfer target medium) may be stacked inside this paper holder 60. A pickup roller 61 may be positioned at the upper left corner of the paper holder 60, and a pair of rollers 63 and a roller 65 may be arranged sequentially downstream in the direction in which the paper P is fed by the pickup roller 61. The sheet of recording paper positioned on the top of the stack of paper can be picked up from the paper holder 60 by the rotation of the pickup roller 61, and can be then transported by the pair of rollers 63 and the roller 65.

Furthermore, a transfer device 42 may be positioned on the opposite side of the intermediate transfer belt 50 to the roller 55. The sheet of paper P transported by the pair of rollers 63 and the roller 65 can be fed between the intermediate transfer belt 50 and the transfer device 42, and the transfer device 42 can transfer the toner image formed on the image formation surface of the intermediate transfer belt 50 to the sheet of paper P. A fixing device 44 equipped with a pair of fixing rollers may be positioned on the downstream side of the transfer device 42 in the transport direction of the paper P, and once the transferred toner image has been fused and fixed by the fixing device 44, the paper P bearing the transferred toner image can be ejected from the image forming apparatus 130 and placed on an ejected paper receiver (not shown in the figure).

There are no particular restrictions on the structures of the process cartridge according to an exemplary embodiment the present invention, and the image forming apparatus of an exemplary embodiment of the present invention, and conventional structures may be used.

EXAMPLES

A more detailed description of the present invention is presented below with reference to a series of examples and comparative examples, but the present invention is in no way limited by these examples.

<Method of Producing Charging Rollers A to E>

A core metal (Ni electroless deposition-treated SUM) having a length of 240 mm and an outer diameter of 8 mm is prepared as the conductive core. Onto this conductive core is sequentially formed, via an adhesive layer containing a phenol-based conductive adhesive (film thickness: 3 μm), an ion conductive layer that also functions as a thick-film conductive elastic layer, and a surface layer, with these layers having the compositions shown below in Table 2, thereby forming charging rollers A to E. In Table 2, each of the materials used is described in Table 3. Further, the blend quantities shown in Table 2 represent parts by mass.

TABLE 2

| | | | Material | Blend quantity | | | | |
|---|---|---|---|---|---|---|---|---|
| | | | | Charging roller A | Charging roller B | Charging roller C | Charging roller D | Charging roller E |
| Ion-conductive layer | Composition | Rubber | epichlorohydrin rubber | 95.6 | 75 | 95.6 | 95.6 | 95.6 |
| | | | nitrile butadiene rubber | 4.4 | 25 | 4.4 | 4.4 | 4.4 |
| | | Conductivity imparting agent | benzyltriethylammonium chloride | 0.9 | | | | |
| | | | PEL20A | | 0.9 | | | |
| | | | lithium perchlorate | | | 3 | 3 | 3 |
| | | | carbon black | 15 | 10 | 15 | 15 | 15 |
| | | Vulcanizing agent | sulfur | 1.5 | 1.5 | 1.5 | 1.5 | 1.5 |
| | | Vulcanization accelerator | tetramethyllithium disulfide | 1.5 | 1.5 | 1.5 | 1.5 | 1.5 |
| | | | dibenzothiazole disulfide | 1.5 | 1.5 | 1.5 | 1.5 | 1.5 |
| | | Filler | calcium carbonate | 20 | 20 | 20 | 20 | 20 |
| | | Vulcanization accelerator | stearic acid | 1 | 1 | 1 | 1 | 1 |
| | | | zinc oxide | 5 | 5 | 5 | 5 | 5 |
| | | Film thickness (mm) | | 3 | 3 | 3 | 3 | 3 |
| Surface Layer | Composition | Resin | polyester resin | 64.1 | | | | |
| | | | melamine resin | 16.9 | | | | 16.9 |
| | | | alcohol-soluble copolymer nylon | | 90.9 | | | |
| | | | N-methoxymethylated nylon | | | 90.9 | | |
| | | | polyurethane resin | | | | 90.9 | |
| | | | acrylic acid | | | | | 64.1 |
| | | Conductive agent | carbon black | 9.1 | 9.1 | 9.1 | 9.1 | 9.1 |
| | | Other additives | fluororesin | 9.9 | | | | |
| | | Film thickness (μm) | | 15 | 15 | 20 | 20 | 20 |

TABLE 3

| | | Material | Product No./Maker |
|---|---|---|---|
| Ion-conductive layer | Rubber | epichlorohydrin rubber | Gechron 3106/Zeon Corporation |
| | | nitrile butadiene rubber | N250S/JSR Corporation |
| | Conductivity imparting agent | benzyltriethylammonium chloride | Kanto Chemical Co., Inc. |
| | | PEL20A | Japan Carlit Co., Ltd. |
| | | lithium perchlorate | Kanto Chemical Co., Inc. |
| | | carbon black | Ketchen black EC/Lion Corporation |

TABLE 3-continued

| | | Material | Product No./Maker |
|---|---|---|---|
| | Vulcanizing agent | sulfur | SULFAX PS/Tsurumi Chemical Co., Ltd. |
| | Vulcanization accelerator | tetramethyllithium disulfide | NOCCELER TT/Ouchi Shinko Chemical Industrial Co., Ltd. |
| | | dibenzothiazole disulfide | NOCCELER DM/Ouchi Shinko Chemical Industrial Co., Ltd. |
| | Filler | calcium carbonate | Silver W/Shiraishi Kogyo Kaisha, Ltd. |
| | Vulcanization accelerator | stearic acid | Kanto Chemical Co., Inc. |
| | | zinc oxide | Zinc oxide type 1/Seidou Kagaku Kogyo Co., Ltd. |
| Surface layer | Resin | polyester resin | VYLON 30SS/Toyobo Co., Ltd. |
| | | melamine resin | SUPER BECKAMINE G821-60/DIC Corporation |
| | | alcohol-soluble copolymer nylon | CM8000/Toray Industries, Inc. |
| | | N-methoxymethylated nylon | TORESIN EF30T/Nagase ChemteX Corporation |
| | | polyurethane resin | VYLON UR3200/Toyobo Co., Ltd. |
| | | acrylic acid | A801/DIC Corporation |
| | Conductive agent | carbon black | FW200/Degussa GmbH |
| | Other additives | fluororesin | LUBRON L-2/Daikin Industries, Ltd. |

<Method of Producing Photoreceptor>

First, a circular cylindrical aluminum base material with an outer diameter of 84 mm that has undergone a honing treatment is prepared. Subsequently, 100 parts by mass of a zirconium compound (product name: ORGATIX ZC540, manufactured by Matsumoto Chemical Industry Co., Ltd.), 10 parts by mass of a silane compound (product name: A1100, manufactured by Nippon Unicar Company, Ltd.), 400 parts by mass of isopropanol, and 200 parts by mass of butanol are mixed together, yielding an undercoat layer-forming coating liquid. This coating liquid is applied to the aluminum base material by dip coating, and is then heated and dried at 150° C. for 10 minutes, forming an undercoat layer of 0.1 μm.

Subsequently, 1 part by mass of hydroxygallium phthalocyanine, which has strong diffraction peaks at Bragg angles (2θ±0.2°) of 7.5°, 9.9°, 12.5°, 16.3°, 18.6°, 25.1°, and 28.3° in the CuKa characteristic X-ray diffraction spectrum, 1 part by mass of a polyvinyl butyral (product name: S-LEC BM-S, manufactured by Sekisui Chemical Co., Ltd.), and 100 parts by mass of n-butyl acetate are mixed together, and the mixture is then dispersed, together with glass beads, for one hour using a paint shaker, thus yielding a charge generation layer-forming coating liquid. This coating liquid is applied to the undercoat layer by dip coating, and is then heated and dried at 100° C. for 10 minutes, forming a charge generation layer with a film thickness of approximately 0.15 μm.

Next, 2 parts by mass of a charge transport material shown below in the formula (VT-1), 3 parts by mass of a high-molecular weight compound (viscosity average molecular weight: 50,000) having a structural unit shown below in the formula (VI-2), and 20 parts by mass of chlorobenzene are mixed; yielding a charge transport layer-forming coating liquid.

(VI-1)

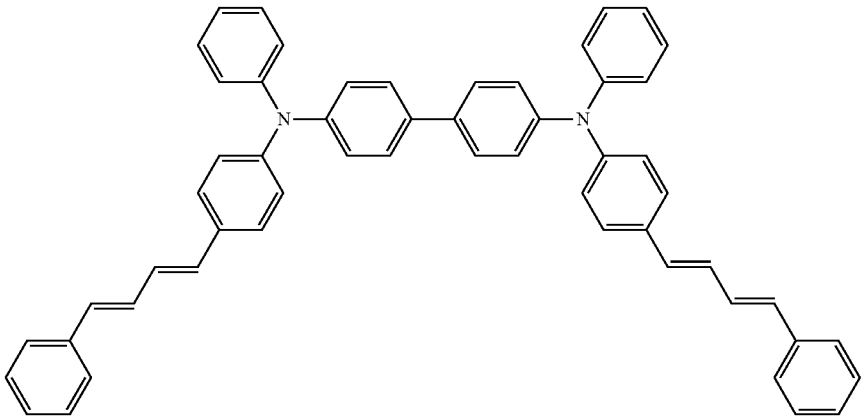

(VI-2)

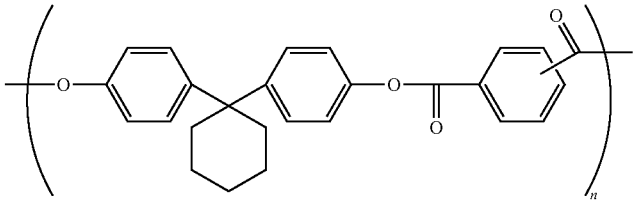

The thus obtained charge transport layer-forming coating liquid is applied to the charge generation layer using a dip coating method, and is then heated at 110° C. for 40 minutes, forming a charge transport layer with a film thickness of 20 μm. A photoreceptor having the undercoat layer, the charge generation layer and the charge transport layer formed on the honed aluminum base material in this manner is referred to as "photoreceptor 1".

Subsequently, 7 parts by mass of a resol-type phenolic resin (PL-2211, manufactured by Gun Ei Chemical Industry Co., Ltd.) and 0.03 parts by mass of a methylphenylpolysiloxane are prepared. These components are then dissolved in 15 parts by mass of isopropanol and 5 parts by mass of methyl ethyl ketone, yielding a protective layer-forming coating liquid. This coating liquid is applied to the photoreceptor 1 using a dip coating method, and is then dried at 130° C. for 40 minutes, forming a protective layer with a thickness of 3 μm. The thus obtained photoreceptor is referred to as "photoreceptor 2".

<Production of Cleaning Roller a>

A core material composed of SUS303 and with an outer diameter of 5 mm and a length of 230 mm is inserted into a block of urethane foam (EP-70, manufactured by INOAC Corporation) cut to dimensions of 20 mm×20 mm×250 mm. Following bonding of the core material and the urethane foam using a hot-melt adhesive, the urethane foam is cut away for a length of 5 mm from both tips of the core material, thus forming a cleaning roller element. This roller element is subjected to a grinding treatment, yielding a cleaning roller a with an outer diameter of 9 mm.

Measurement of the hardness of the elastic layer of the cleaning roller a using the method described below reveals a result of 315 N.

[Method of Measuring Hardness]

The hardness is measured in accordance with Method A described in JIS K6400 (1997). Using pressure plates of diameter of 200 mm, a load of 4.9 N is applied to a sample of dimensions 50×390×390 mm, and the thickness of the sample under this load is deemed the initial thickness. Subsequently, a pre-compression of 75% is applied to the sample using the pressure plates, the load is immediately released, a second compression of 25% is applied, and the load (N) is measured 20 seconds after application of the 25% compression, and recorded as the hardness.

<Production of Cleaning Rollers b to e>

The respective blend quantities of the materials within the formulations a to d shown in Table 4 are weighed out. A high-speed mixer is then used to thoroughly mix each of the formulations. Subsequently, each of the blended liquids is transferred to a metal tray, foamed, and then left to stand overnight, thereby yielding urethane foams a to d.

The thus obtained urethane foams a to d are cut into blocks of dimensions 20 mm×20 mm×250 mm, a core material composed of SUS303 and with an outer diameter of 5 mm and a length of 230 mm is inserted into each block of urethane foam, and following bonding of the core material and the urethane foam using a hot-melt adhesive, the urethane foam is cut away for a length of 5 mm from both tips of the core material, thus forming a cleaning roller element. The roller elements are subjected to a grinding treatment, yielding cleaning rollers b to e, each having an outer diameter of 9 mm. Measurement of the hardness of the cleaning rollers b to e revealed the values shown in Table

TABLE 4

| | | Urethane foam a Formulation a | Urethane foam b Formulation b | Urethane foam c Formulation c | Urethane foam d Formulation d |
|---|---|---|---|---|---|
| Polyol | Polyether polyol 1 | 100 | 100 | 100 | |
| | Polyether polyol 2 | | | | 100 |
| Foam regulator | Silicone-based foam regulator | 1 | 1 | 1 | 1 |
| Foaming agent | Water | 4 | 2.5 | 1 | 6 |
| Catalyst | triethylenediamine | 0.1 | 0.1 | 0.1 | 0.1 |
| | tin octylate | 0.26 | 0.26 | 0.26 | 0.26 |
| Crosslinking agent | isocyanate (TDI) | 54.6 | 54.6 | 54.6 | 54.6 |

Polyether polyol 1: SANNIX GP3030, manufactured by Sanyo Chemical Industries, Ltd.
Polyether polyol 2: SANNIX FA242, manufactured by Sanyo Chemical Industries, Ltd.
Silicone-based foam regulator: L520, manufactured by Nippon Unicar Company, Ltd.
Triethylenediamine: manufactured by Air Products and Chemicals, Inc.
Tin octylate: manufactured by Nitto Kasei Co., Ltd.
isocyanate (TDI): T-80, manufactured by Nippon Polyurethane Industry Co., Ltd.

TABLE 5

| Cleaning member | Material | Shape | Product name | Manufacturer/Maker | Hardness (N) |
|---|---|---|---|---|---|
| a | polyurethane | circular cylinder (roller-shaped) | EP270 | INOAC Corporation | 315 |
| b | polyurethane | circular cylinder (roller-shaped) | Urethane foam a | | 125 |
| c | polyurethane | circular cylinder (roller-shaped) | Urethane foam b | | 460 |
| d | polyurethane | circular cylinder (roller-shaped) | Urethane foam c | | 530 |
| e | polyurethane | circular cylinder (roller-shaped) | Urethane foam d | | 76 |

Example 1

The cleaning roller of the example 1 is prepared by subjecting the cleaning roller a to a heat treatment in an open atmosphere, using a dryer (DFB-80H, manufactured by Irie Shokai Co., Ltd.) under the heating conditions shown in Table 6 (130° C., 30 minutes) When the residual amine content is measured using a gas chromatograph apparatus under the conditions listed below, the residual amine content within the elastic layer of the cleaning roller of the example 1 is 6 ppm. Furthermore, the residual amine is composed mainly of the tertiary amine triethylenediamine. The lower detection limit for this apparatus is approximately 0.1 ppm.

[Thermal Desorption Unit]

Apparatus: Double Shot Pyrolyzer PY-2010D (manufactured by Frontier Laboratories Ltd.)

Heating temperature: 180° C.

Interface temperature: 200° C.

[GC]

Apparatus: HP6890 GC System (manufactured by Hewlett-Packard Development Company)

Column: Agilent 19091S-433 HP5MS (5% Phenyl Methyl Siloxane) (manufactured by Hewlett-Packard Development Company)

Split ratio: 1/1

Flow rate: 1.0 ml/min.

Temperature raising profile: 40° C. (3 min.)→10° C./min.→250° C. (5 min.)

[MS]

Apparatus: 5973 Mass Selective Detector (manufactured by Hewlett-Packard Development Company)

Ionization method: EI

Mass range: 50 to 800 m/z

<Image Evaluation>

The cleaning roller obtained in the example 1, the charging roller A described above, and the photoreceptor described above are installed in a DOCUPRINT 500 apparatus (manufactured by Fuji Xerox Co., Ltd.) that has been modified to fit these components, and a continuous print test is conducted by printing 100,000 copies. The evaluation criteria used are shown below, with the judgment being made by visual observation. Evaluations from A to D are considered passing evaluations.

A: Absolutely no change from the initial image quality.

B: Almost no change from the initial image quality.

C: A slight deterioration in the image quality from the initial quality level, but at an unproblematic level.

D: Some deterioration in the image quality from the initial quality level.

E: Considerable deterioration in the image quality from the initial quality level.

Example 2 to Example 13

Using the cleaning rollers a to e, a similar heat treatment to that described in the example 1 is conducted under the conditions shown in Table 6, yielding cleaning rollers of each of the examples. With the exception of using the combinations of cleaning rollers and charging rollers shown in Table 6, evaluations are conducted in the same manner as the example 1. The results of those evaluations are shown in Table 6.

Comparative Example 1

The cleaning roller a prepared in the example 1 is subjected to a heat treatment under the heating conditions shown in Table 6, thus yielding a cleaning roller of the comparative example 1, and a combination of this cleaning roller with the charging roller and photoreceptor shown in Table 6 is evaluated in the same manner as the example 1. The result of the evaluation is shown in Table 6.

TABLE 6

| | Example 1 | Example 2 | Example 3 | Example 4 | Example 5 | Example 6 | Example 7 | Example 8 | Example 9 | Example 10 | Example 11 | Example 12 | Example 13 | Comparative example 1 |
|---|---|---|---|---|---|---|---|---|---|---|---|---|---|---|
| Photoreceptor | 1 | 1 | 1 | 1 | 1 | 1 | 1 | 1 | 2 | 1 | 1 | 1 | 1 | 1 |
| Charging roller | A | A | A | A | B | C | D | E | A | C | D | A | A | A |
| Cleaning member | a | a | b | c | a | a | a | a | c | b | c | d | e | a |
| Shape of cleaning member | roller | roller | roller | roller | roller | roller | roller | roller | roller | roller | roller | roller | roller | roller |
| Heating conditions Temperature (° C.) | 130 | 130 | 80 | 160 | 130 | 130 | 130 | 130 | 140 | 180 | 180 | 130 | 130 | 130 |
| Time (min) | 30 | 10 | 60 | 30 | 30 | 30 | 30 | 30 | 20 | 60 | 20 | 30 | 30 | 5 |
| Residual amine content (ppm) | 6 | 56 | 24 | 12 | 6 | 6 | 6 | 6 | 29 | 0.05 | 5 | 11 | 16 | 65 |
| Evaluation of cleaning performance and image quality | C | C | C | C | B | B | A | A | C | D | D | D | D | E |

As can be seen, the cleaning rollers of the examples 1 to 13 enable the cleaning performance to be maintained over a long period of time.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A charging device, comprising a charging member and a charging member cleaning unit that contacts the charging member, wherein the charging member has a conductive elastic layer comprising an ion-conductive agent, and the charging member cleaning unit has an elastic layer, and has an amine content within the elastic layer of not more than approximately 60 ppm.

2. The charging device according to claim 1, wherein the amine content is not more than approximately 30 ppm.

3. The charging device according to claim 1, wherein a hardness of the elastic layer is within a range from not less than approximately 100 N to not more than approximately 500 N.

4. The charging device according to claim 1, wherein the elastic layer comprises a polyurethane foam.

5. The charging device according to claim 1, wherein the amine is a tertiary amine.

6. The charging device according to claim 1, wherein the charging member comprises a conductive core and a surface layer, and the surface layer comprises at least one resin selected from the group consisting of polyamide resins, polyester resins, polyurethane resins and acrylic resins.

7. The charging device according to claim 6, wherein the polyamide resin is at least one of an alcohol-soluble copolymer nylon and an N-methoxymethylated nylon.

8. The charging device according to claim 1, wherein the conductive elastic layer comprises a polar polymer.

9. The charging device according to claim 8, wherein the polar polymer is at least one polymer selected from the group consisting of epichlorohydrin rubbers, epichlorohydrin-ethylene oxide copolymer rubbers, acrylonitrile butadiene rubbers, and urethane rubbers.

10. The charging device according to claim 1, wherein the ion-conductive agent comprises a quaternary ammonium salt.

11. A process cartridge, comprising an image holding member and a charging device that charges a surface of the image holding member, wherein the charging device comprises a charging member and a charging member cleaning unit that contacts the charging member, the charging member has a conductive elastic layer comprising an ion-conductive agent, and the charging member cleaning unit has an elastic layer, and has an amine content within the elastic layer of not more than approximately 60 ppm.

12. The process cartridge according to claim 11, wherein the amine is a tertiary amine.

13. An image forming apparatus, comprising:

an image holding member;

a charging device that charges a surface of the image holding member, comprising a charging member and a charging member cleaning unit that contacts the charging member;

a latent image-forming unit that forms a latent image on the surface of the image holding member;

a developing unit that develops the latent image formed on the surface of the image holding member using a toner, thereby forming a toner image; and a transfer unit that transfers the toner image formed on the surface of the image holding member to a transfer target, wherein the charging member has a conductive elastic layer comprising an ion-conductive agent, and the charging member cleaning unit has an elastic layer, and has an amine content within the elastic layer of not more than approximately 60 ppm.

14. The image forming apparatus according to claim 13, wherein the amine is a tertiary amine.

* * * * *